US010380937B2

(12) United States Patent
Tang et al.

(10) Patent No.: US 10,380,937 B2
(45) Date of Patent: Aug. 13, 2019

(54) MULTI-ZONED VARIABLE VCOM CONTROL

(71) Applicant: Apple Inc., Cupertino, CA (US)

(72) Inventors: Howard H. Tang, San Diego, CA (US); Paolo Sacchetto, Cupertino, CA (US); Chaohao Wang, Sunnyvale, CA (US); Szu-Hsien Lee, San Jose, CA (US); Patrick Bennett, Alameda, CA (US); Fenghua Zheng, San Jose, CA (US)

(73) Assignee: Apple Inc., Cupertino, CA (US)

( * ) Notice: Subject to any disclaimer, the term of this patent is extended or adjusted under 35 U.S.C. 154(b) by 190 days.

(21) Appl. No.: 15/246,666

(22) Filed: Aug. 25, 2016

(65) Prior Publication Data

US 2017/0061864 A1 Mar. 2, 2017

Related U.S. Application Data

(60) Provisional application No. 62/210,252, filed on Aug. 26, 2015.

(51) Int. Cl.
*G09G 3/20* (2006.01)
*G09G 3/36* (2006.01)

(52) U.S. Cl.
CPC ..... *G09G 3/2096* (2013.01); *G09G 3/3655* (2013.01); *G09G 3/3666* (2013.01);
(Continued)

(58) Field of Classification Search
CPC ..... G09G 3/36; G09G 3/3655; G09G 3/3696; G09G 3/3614; G09G 3/3648; G09G 3/3677; G09G 3/3611; G09G 3/3666; G09G 3/3688; G09G 2300/0426; G09G 2300/0408; G09G 2300/0876; G09G 2310/027; G09G 2310/0289; G09G 2310/0291; G09G 2310/06;
(Continued)

(56) References Cited

U.S. PATENT DOCUMENTS 9,007,098 B1 4/2015 Viviani et al.
9,542,913 B2 * 1/2017 Wang ..... G09G 5/18
(Continued)

FOREIGN PATENT DOCUMENTS

CN 104050942 A 9/2014
WO 2014088629 A1 6/2015

OTHER PUBLICATIONS

Invitation and Partial Search Report for PCT Application PCT/US2016/048867 dated Oct. 24, 2016; 8 pgs.

*Primary Examiner* — Aneeta Yodichkas
(74) *Attorney, Agent, or Firm* — Fletcher Yoder PC

(57) ABSTRACT

The disclosure relates to systems and methods for reducing VCOM settling periods. A number of pixels is sub-divided into a plurality of regions. The pixels are configured to transmit light. A common voltage (VCOM) driving circuit is configured to drive a common electrode of the pixels. Moreover, each of a number of VCOM driving circuits includes a variable resistor configured to be driven to a resistance level based at least in part on which region of the plurality of regions includes an active pixel within the region. Furthermore, a resistance level is set and based at least in part on where the active pixel is located.

22 Claims, 22 Drawing Sheets

(52) U.S. Cl.
CPC ..... *G09G 2300/0426* (2013.01); *G09G 2310/0291* (2013.01); *G09G 2320/0223* (2013.01); *G09G 2320/0233* (2013.01); *G09G 2320/0257* (2013.01); *G09G 2320/0266* (2013.01)

(58) Field of Classification Search
CPC ... G09G 2320/0223; G09G 2320/0693; G09G 2320/0285; G09G 2320/0233; G09G 2320/0219; G09G 2320/0247; G09G 2320/0209; G09G 2320/0204; G09G 2320/029; G09G 2330/021; G09G 2330/02; G09G 2360/145; G02F 1/13306; G02F 1/13338; G02F 1/136213; G02F 1/13454; G02F 1/136204; G02F 1/136286; G02F 1/134363; G02F 1/1368; G02F 1/13452; G02F 2201/121; G02F 2201/123; G02F 2001/13606; G06F 3/044; G06F 3/0416; G06F 3/03545; G06F 3/0412; G06F 2203/04104
See application file for complete search history.

(56) References Cited

U.S. PATENT DOCUMENTS

2005/0156840 A1* 7/2005 Kim ..... G09G 3/3655 345/87
2005/0200588 A1 9/2005 Kaneda
2006/0244704 A1 11/2006 JaeHun
2008/0117148 A1* 5/2008 Tu ..... G09G 3/3696 345/87
2008/0303763 A1* 12/2008 Lim ..... G09G 3/3655 345/87
2008/0303770 A1 12/2008 Oke et al.
2010/0053056 A1* 3/2010 Lee ..... G02F 1/1345 345/94
2010/0245326 A1* 9/2010 Xiao ..... G09G 3/3655 345/211
2012/0194318 A1 8/2012 Chin
2012/0200588 A1 8/2012 Okumura
2013/0314393 A1 11/2013 Min et al.
2013/0328755 A1* 12/2013 Al-Dahle ..... G09G 3/3655 345/87
2014/0111496 A1 4/2014 Gomez et al.
2015/0356951 A1 12/2015 Wang

* cited by examiner

MULTI-ZONED VARIABLE VCOM CONTROL

CROSS-REFERENCE TO RELATED APPLICATIONS

This application claims the benefit of Provisional Application Ser. No. 62/210,252, filed Aug. 26, 2015, entitled "Multi-zoned Variable VCOM Control," which is incorporated by reference herein in its entirety.

BACKGROUND

The present disclosure relates generally to techniques for displaying images and, more particularly, to techniques for controlling a common electrode voltage (VCOM) or VCOM plate.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

As display panel refresh rates increase, line times become shorter and shorter. This is especially true when the displays are relatively large displays. These shorter line times reduce a period of time for which the VCOM for the display can settle. If VCOM does not settle before a next write mode, the display may show artifacts due to improper voltage differences across the pixels and/or sub-pixels of the display (e.g., LCD or OLED) during the write mode.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In accordance with the present techniques, a display that allocates various portions of the display to one or more common voltage (VCOM) amplifier circuits. Moreover, the location of the VCOM amplifier circuits and their corresponding regions may be chosen to reduce and/or minimize trace distances between the VCOM amplifier circuits and the display regions to which they are connected. For example, a "head to head" configuration may be used to drive a common electrode of the pixels from opposite sides of the pixels thereby reducing the amplifier output resistances due to reduction in non-glass (e.g., trace) related resistances. Additionally or alternatively, a same-side amplifier configuration may be used for two or more VCOM amplifier circuits on the same side of the pixels to drive a VCOM associated with a portion of the panel active area. Furthermore, a resistance of variable resistors of the VCOM amplifier circuits may be selected based on distances between the VCOM amplifier circuit and an active pixel being written.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

In accordance with the present techniques, a display that allocates various portions of the display to one or more common voltage (VCOM) amplifier circuits. Moreover, the location of the VCOM amplifier circuits and their corresponding regions may be chosen to reduce and/or minimize trace distances between the VCOM amplifier circuits and the display regions to which they are connected. For example, a "head to head" configuration may be used to drive a common electrode of the pixels from opposite sides of the pixels thereby reducing the amplifier output resistances due to reduction in non-glass (e.g., trace) related resistances. Additionally or alternatively, a same-side amplifier configuration may be used for two or more VCOM amplifier circuits on the same side of the pixels to drive a portion of the panel active area. Furthermore, a resistance of variable resistors of the VCOM amplifier circuits may be selected based on distances between the VCOM amplifier circuit and an active pixel being written.

Special on-glass wire routing precautions and amplifier driving/feedback panel locations may be selected such that VCOM feedback schemes do not create oscillations. The determination of panel tap point locations and numbers involve sheet resistance, parasitics, and/or other display characteristics. In other words, the VCOM plane can be driven by multiple VCOM buffers where each amplifier drives/senses a subsection of the panel area.

Moreover, the VCOM functionalities may be incorporated inside dual head gate driver integrated circuits (GDIC). Dual head GDICs provide automatic Head to Head VCOM driving and sensing, capability to synchronize VCOM driving functionality with GDIC activities, enable certain parts of the panel where GDIC to be inactive and driven with lower power buffers instead of the full strength buffers, and VCOM drive and sense lines can route through GDICs.

Figure 1:
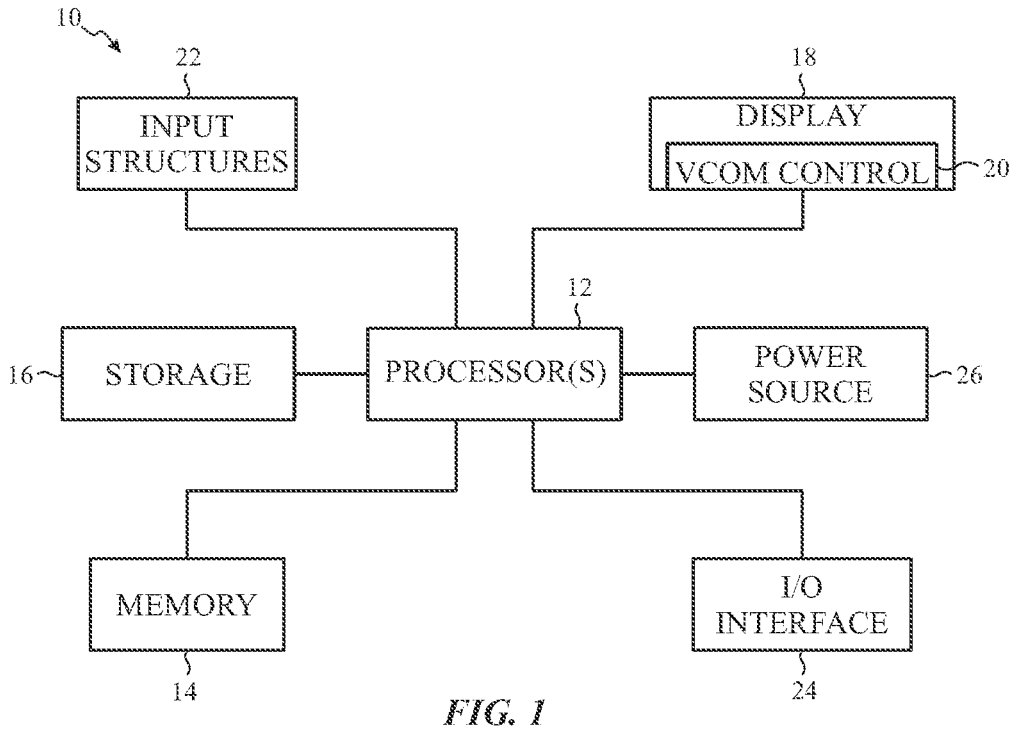
FIG. 1 is a schematic block diagram of an electronic device including display control circuitry, in accordance with an embodiment.

With these features in mind, a general description of suitable electronic devices that may use variable VCOM control with two or more VCOM amplifiers. Turning first to FIG. 1, an electronic device 10 according to an embodiment of the present disclosure may include, among other things, one or more processor(s) 12, memory 14, nonvolatile storage 16, a display 18 with VCOM control circuitry 20, input structures 22, an input/output (I/O) interface 24 and a power source 26. The various functional blocks shown in FIG. 1 may include hardware elements (e.g., including circuitry), software elements (e.g., including computer code stored on a computer-readable medium) or a combination of both hardware and software elements. It should be noted that FIG. 1 is merely one example of a particular implementation and is intended to illustrate the types of components that may be present in electronic device 10.

Figure 2:
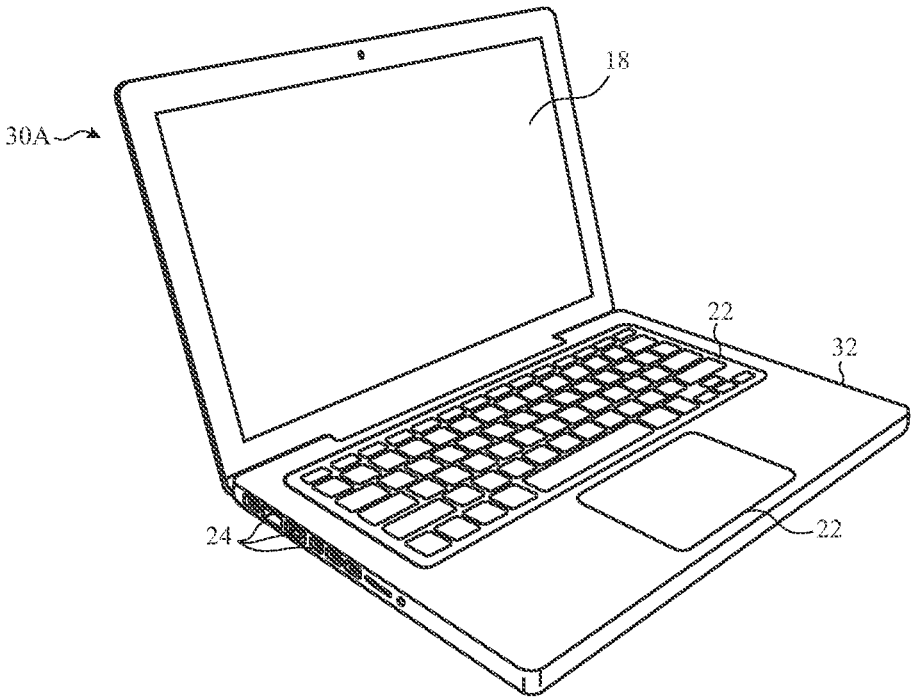
FIG. 2 is a perspective view of a notebook computer representing an embodiment of the electronic device of FIG. 1, in accordance with an embodiment.
Figure 3:
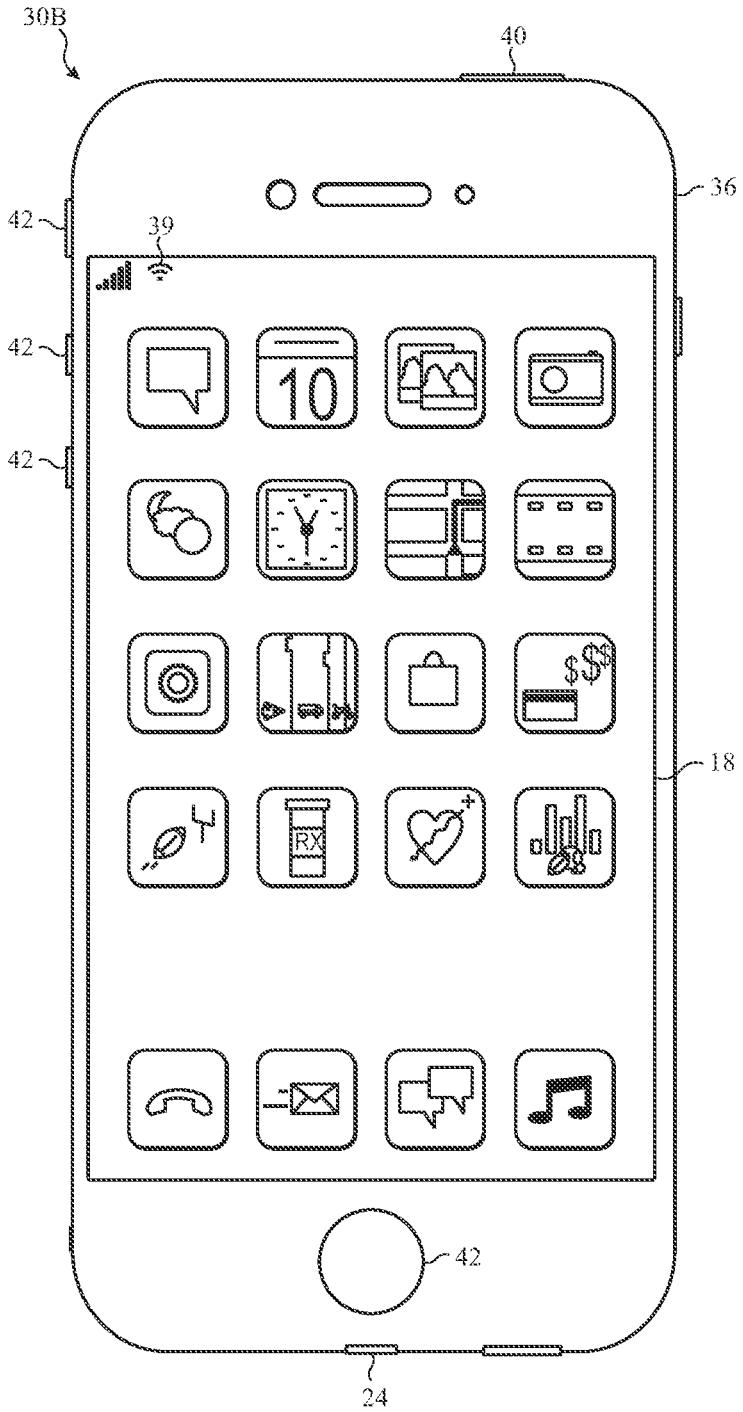
FIG. 3 is a front view of a hand-held device representing another embodiment of the electronic device of FIG. 1, in accordance with an embodiment.
Figure 4:
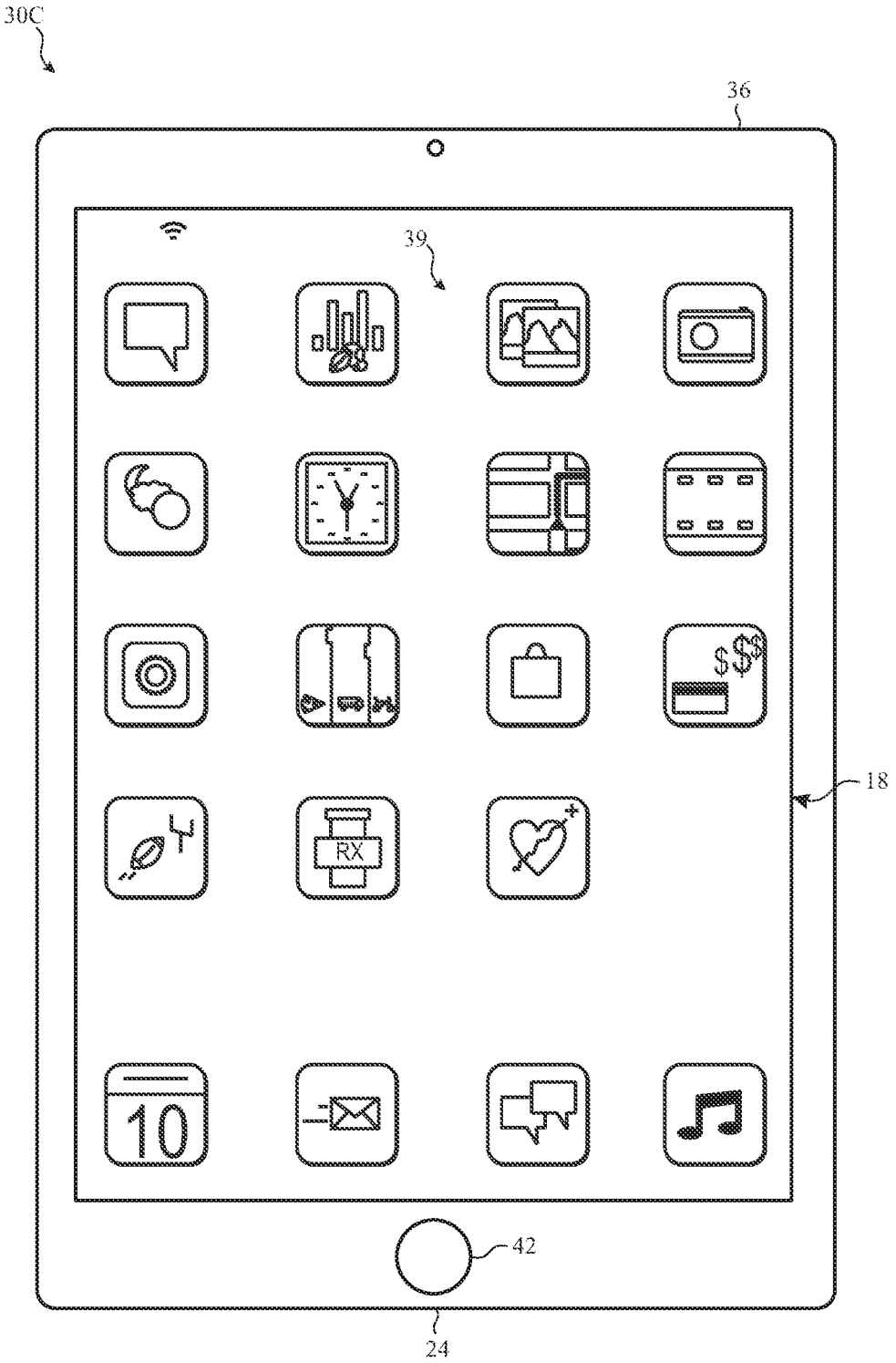
FIG. 4 is a front view of another hand-held device representing another embodiment of the electronic device of FIG. 1, in accordance with an embodiment.
Figure 5:
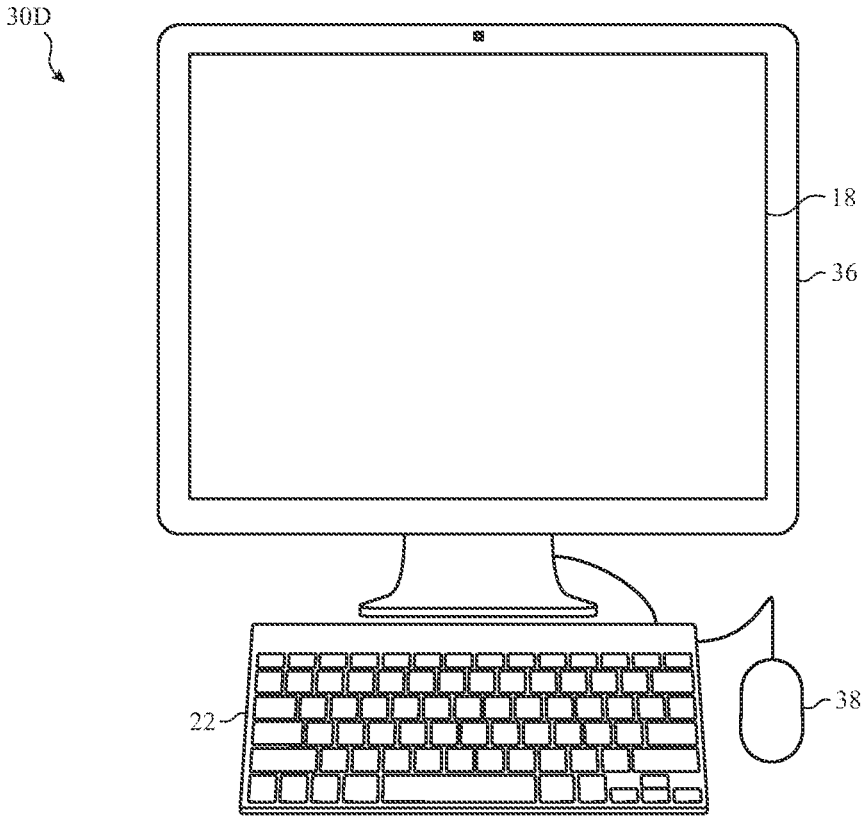
FIG. 5 is a front view of a desktop computer representing another embodiment of the electronic device of FIG. 1, in accordance with an embodiment.
Figure 6:
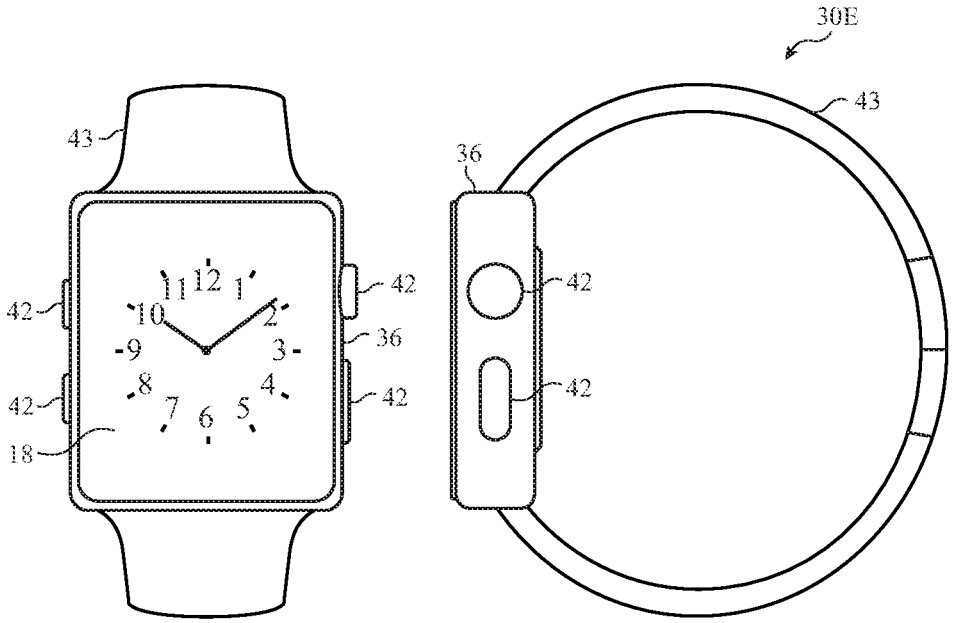
FIG. 6 is a front view of a wearable electronic device representing another embodiment of the electronic device of FIG. 1, in accordance with an embodiment.

By way of example, the electronic device 10 may represent a block diagram of the notebook computer depicted in FIG. 2, the handheld device depicted in either of FIG. 3 or FIG. 4, the desktop computer depicted in FIG. 5, the wearable electronic device depicted in FIG. 6, or similar devices. It should be noted that the processor(s) 12 and/or other data processing circuitry may be generally referred to herein as "data processing circuitry." Such data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In the electronic device 10 of FIG. 1, the processor(s) 12 and/or other data processing circuitry may be operably coupled with the memory 14 and the nonvolatile storage 16 to perform various algorithms. Such programs or instructions, including those for executing the techniques described herein, executed by the processor(s) 12 may be stored in any suitable article of manufacture that includes one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and optical discs. Also, programs (e.g., e.g., an operating system) encoded on such a computer program product may also include instructions that may be executed by the processor(s) 12 to enable the electronic device 10 to provide various functionalities.

In certain embodiments, the display 18 may be a liquid crystal display (e.g., LCD), which may allow users to view images generated on the electronic device 10. In some embodiments, the display 18 may include a touch screen, which may allow users to interact with a user interface of the electronic device 10. Furthermore, it should be appreciated that, in some embodiments, the display 18 may include one or more light emitting diode (e.g., LED) displays, or some combination of LCD panels and LED panels. As previously noted, the display 18 also includes VCOM control circuitry 20. The VCOM control circuitry 20 includes VCOM driving circuitry, such as two or more amplifiers used to drive respective portions of the display 18.

The input structures 22 of the electronic device 10 may enable a user to interact with the electronic device 10 (e.g., e.g., pressing a button to increase or decrease a volume level). The I/O interface 24 may enable electronic device 10 to interface with various other electronic devices. The I/O interface 24 may include various types of ports that may be connected to cabling. These ports may include standardized and/or proprietary ports, such as USB, RS232, Apple's Lightning® connector, as well as one or more ports for a conducted RF link. The I/O interface 24 may also include, for example, interfaces for a personal area network (e.g., PAN), such as a Bluetooth network, for a local area network (e.g., LAN) or wireless local area network (e.g., WLAN), such as an 802.11x Wi-Fi network, and/or for a wide area network (e.g., WAN), such as a 3rd generation (e.g., 3G) cellular network, 4th generation (e.g., 4G) cellular network, or long term evolution (e.g., LTE) cellular network. The I/O interface 24 may also include interfaces for, for example, broadband fixed wireless access networks (e.g., WiMAX), mobile broadband Wireless networks (e.g., mobile WiMAX), and so forth.

As further illustrated, the electronic device 10 may include a power source 26. The power source 26 may include any suitable source of power, such as a rechargeable lithium polymer (e.g., Li-poly) battery and/or an alternating current (e.g., AC) power converter. The power source 26 may be removable, such as a replaceable battery cell.

In certain embodiments, the electronic device 10 may take the form of a computer, a portable electronic device, a wearable electronic device, or other type of electronic device. Such computers may include computers that are generally portable (e.g., such as laptop, notebook, and tablet computers) as well as computers that are generally used in one place (e.g., such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 30A, is illustrated in FIG. 2 in accordance with one embodiment of the present disclosure. The depicted computer 30A may include a housing or enclosure 32, a display 18, input structures 22, and ports of the I/O interface 24. In one embodiment, the input structures 22 (e.g., such as a keyboard and/or touchpad) may be used to interact with the computer 30A, such as to start, control, or operate a GUI or applications running on computer 30A. For example, a keyboard and/or touchpad may allow a user to navigate a user interface or application interface displayed on display 18.

FIG. 3 depicts a front view of a handheld device 30B, which represents one embodiment of the electronic device 10. The handheld device 34 may represent, for example, a portable phone, a media player, a personal data organizer, a handheld game platform, or any combination of such devices. By way of example, the handheld device 34 may be a model of an iPod® or iPhone® available from Apple Inc. of Cupertino, Calif.

The handheld device 30B may include an enclosure 36 to protect interior components from physical damage and to shield them from electromagnetic interference. The enclosure 36 may surround the display 18, which may display indicator icons 39. The indicator icons 39 may indicate, among other things, a cellular signal strength, Bluetooth connection, and/or battery life. The I/O interfaces 24 may open through the enclosure 36 and may include, for example, an I/O port for a hard wired connection for charging and/or content manipulation using a connector and protocol, such as the Lightning connector provided by Apple Inc., a universal serial bus (e.g., USB), one or more conducted RF connectors, or other connectors and protocols.

User input structures 40 and 42, in combination with the display 18, may allow a user to control the handheld device 30B. For example, the input structure 40 may activate or deactivate the handheld device 30B, one of the input structures 42 may navigate user interface to a home screen, a user-configurable application screen, and/or activate a voice-recognition feature of the handheld device 30B, while other of the input structures 42 may provide volume control, or may toggle between vibrate and ring modes. Additional input structures 42 may also include a microphone may obtain a user's voice for various voice-related features, and a speaker to allow for audio playback and/or certain phone capabilities. The input structures 42 may also include a headphone input to provide a connection to external speakers and/or headphones and/or other output structures.

FIG. 4 depicts a front view of another handheld device 30C, which represents another embodiment of the electronic device 10. The handheld device 30C may represent, for example, a tablet computer, or one of various portable computing devices. By way of example, the handheld device 30C may be a tablet-sized embodiment of the electronic device 10, which may be, for example, a model of an iPad® available from Apple Inc. of Cupertino, Calif.

Turning to FIG. 5, a computer 30D may represent another embodiment of the electronic device 10 of FIG. 1. The computer 30D may be any computer, such as a desktop computer, a server, or a notebook computer, but may also be a standalone media player or video gaming machine. By way of example, the computer 30D may be an iMac®, a MacBook®, or other similar device by Apple Inc. It should be noted that the computer 30D may also represent a personal computer (e.g., PC) by another manufacturer. A similar enclosure 36 may be provided to protect and enclose internal components of the computer 30D such as the dual-layer display 18. In certain embodiments, a user of the computer 30D may interact with the computer 30D using various peripheral input structures 22, such as the keyboard or mouse 38, which may connect to the computer 30D via a wired and/or wireless I/O interface 24.

Similarly, FIG. 6 depicts a wearable electronic device 30E representing another embodiment of the electronic device 10 of FIG. 1 that may be configured to operate using the techniques described herein. By way of example, the wearable electronic device 30E, which may include a wristband 43, may be an Apple Watch® by Apple, Inc. However, in other embodiments, the wearable electronic device 30E may include any wearable electronic device such as, for example, a wearable exercise monitoring device (e.g., e.g., pedometer, accelerometer, heart rate monitor), or other device by another manufacturer. The display 18 of the wearable electronic device 30E may include a touch screen (e.g., e.g., LCD, organic light emitting diode display, active-matrix organic light emitting diode (e.g., AMOLED) display, and so forth), which may allow users to interact with a user interface of the wearable electronic device 30E.

Figure 7:
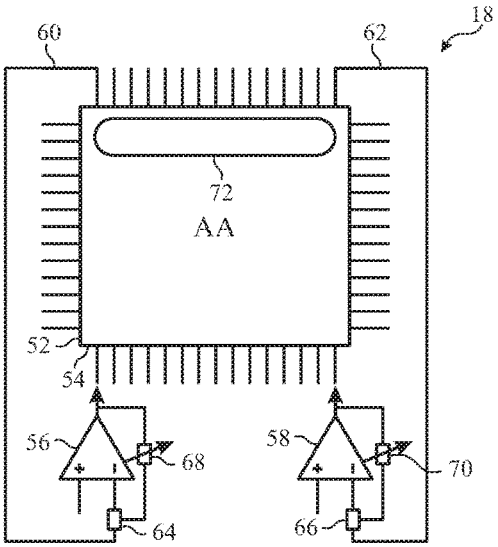
FIG. 7 is a schematic view of a display, according to an embodiment.

As discussed previously, the display 18 may include VCOM drivers. For example, FIG. 7 illustrates an embodiment of the display 18. The display 18 includes an active area 52 that receives, at a common side 54, VCOM signals from VCOM amplifiers 56 and 58. The VCOM amplifiers 56 and 58 receive feedbacks 60 and 62 as negative feedback from a side of the active area 52 opposite the common side 54. The VCOM amplifiers 56 and 58 receive the feedbacks 60 and 62 through feedback resistors 64 and 66. The VCOM amplifiers 56 and 58 also receive feedback through variable resistors 68 and 70 where these variable resistors 68 and 70 provide connection of the output of the VCOM amplifiers 56 and 58 to the negative inputs for the VCOM amplifiers 56 and 58, respectively. For the illustrated embodiment, VCOM voltages in a distant region 72 that is near a side of the active area 52 opposite the common side 54 varies from VCOM voltages in other portions of the active area 52. Specifically, due to resistance differences in trace between the distant region 72 and the other regions of the active area 52.

Figure 8:
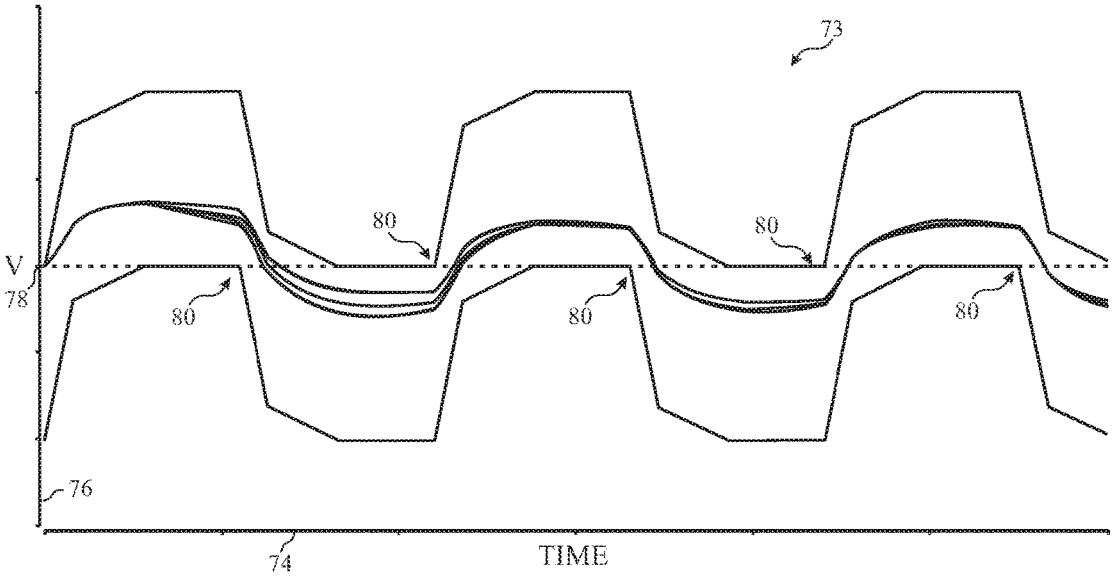
FIG. 8 illustrates a graph of VCOM voltages in a far region of the display of FIG. 7, according to an embodiment.

FIG. 8 illustrates a graph 73 of observed values of VCOM voltages in the distant region 72. The graph 73 includes an abscissa 74 corresponding to time and an ordinate 76 that corresponds to a voltage of the VCOM levels in the distant region 72. The voltage levels fluctuate around a settling voltage 78 to which the VCOM levels should settle after and/or during the write period. However, as illustrated, the voltage levels in a settling region 80 are relatively slow to settle and/or do not settle to the settling voltage 78 before a next write period.

Figure 9:
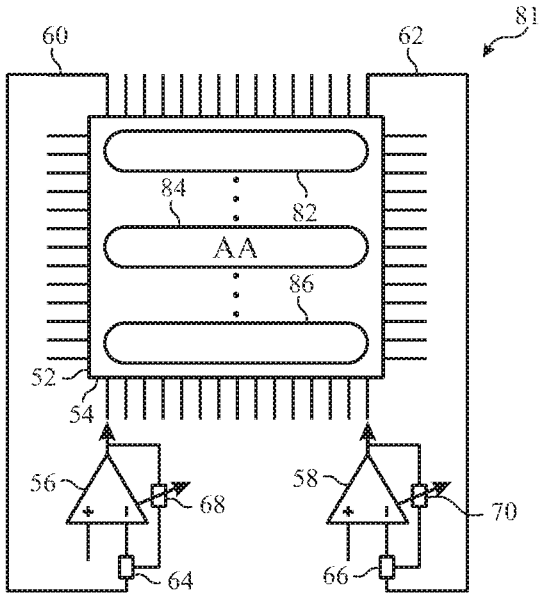
FIG. 9 illustrates a schematic view of a display divided into three regions, according to an embodiment.
Figure 10:
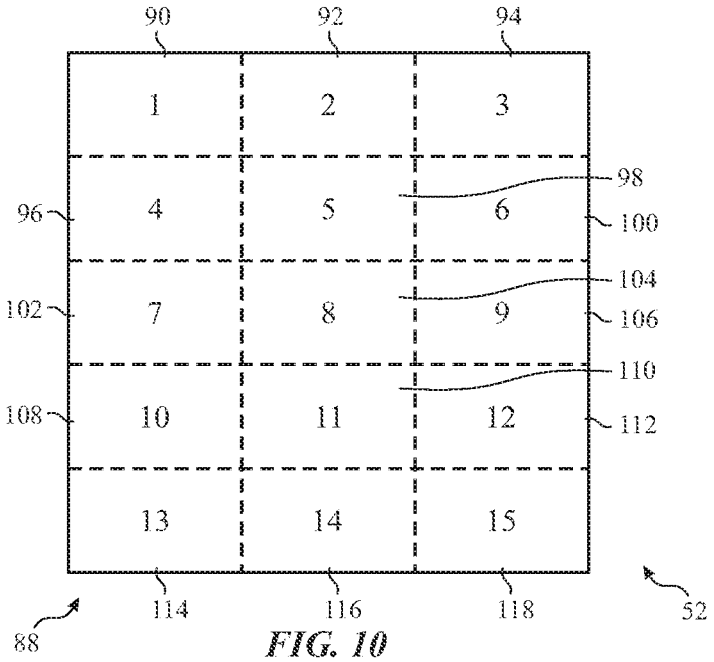
FIG. 10 illustrates a schematic view of a display divided into fifteen regions, according to an embodiment

FIG. 9 illustrates an embodiment 81 of the display 18 where the active area 52 is divided into regions 82, 84, and 86, such that each region is treated differently than other regions. In other words, the variable resistors 68 and 70 may be driven to different levels depending on where an active gate line is located in the active area 52. The illustrated embodiment 81 includes three regions, but the some embodiments may include one, two, three, four, five, or more regions. Furthermore, although the regions 82, 84, and 86 extend across a full width of the active area, some embodiments may divide the regions horizontally and vertically. For example, FIG. 10 illustrates an embodiment 88 of the display 18 with the active area 52 divided into 15 regions. Specifically, the active area 52 is divided into regions 90, 92, 94, 96, 98, 100, 102, 104, 106, 108, 110, 112, 114, 116, and 118, collectively referred to as the regions 90-118. The variable resistors 68 and 70 may be driven at different resistances based on where the active gate is in the active area 52. For example, a lookup table may be stored in memory that indicates what level of resistance should be set based on where the region is. The regions 90-118 may be equally sized or may be progressively smaller as the regions are further away from the common side 54. In other words, the closer regions (e.g., regions 114, 116, and 118) may be larger than further regions (e.g., regions 90, 92, and 94). Alternatively, the regions 90-118 may be progressively larger as the regions are further away from the common side 54.

Figure 11:
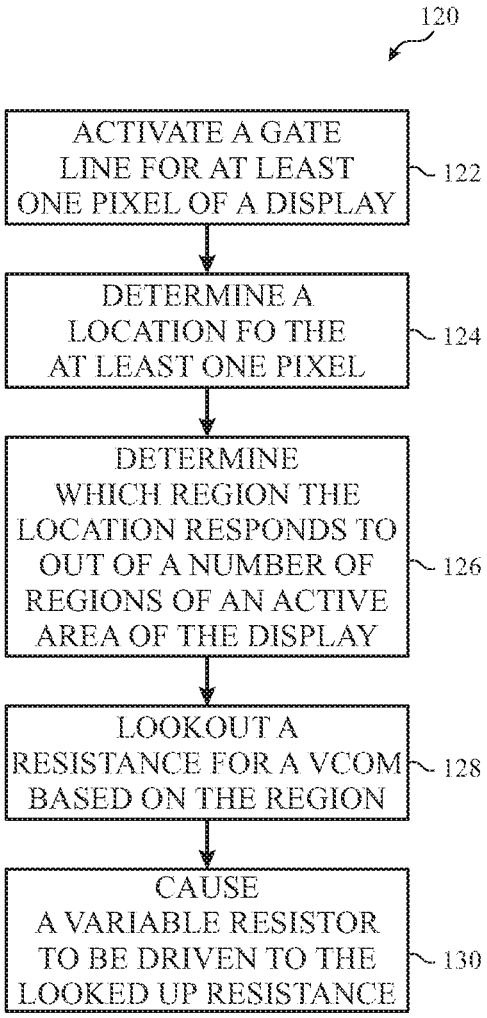
FIG. 11 illustrates a flowchart diagram of a process to reduce VCOM settling periods, according to an embodiment.

FIG. 11 illustrates a flowchart diagram of a process 120 that may be deployed by the electronic device 10 to reduce VCOM settling periods, VCOM fluctuations, and/or visual artifacts. For example, instructions may be stored in the storage 28 and executed by the processor 12. In some embodiments, at least some of the steps may be embodied in hardware. The process 120 includes activating a gate line for at least one pixel of a display (block 122). The processor 12 determines where the active gate line is within an active area of the display 18 (block 124). For example, the processor 12 may determine that the active pixel is in the first line of pixels in a first column of pixels. The processor 12 also determines which region the location corresponds to out of a number (e.g., 15) of regions of the active area of the display 18 (block 126). For example, the active pixel may be in the first region 90 of the regions 90-118 when the active pixel is in the first row and first column.

The processor 12 looks up a resistance value that corresponds to the region (block 128). For example, the processor 12 may examine a lookup table in the storage 28 to determine a resistance that corresponds to the region. For example, the first region 90 may have a relatively high resistance value while the fifteenth region 118 has a relatively low resistance value. The processor 12 then causes a variable resistor to be driven to the looked up resistance (block 130). The variable resistor may be the variable resistor 68 and/or variable resistor 70 of FIGS. 7 and 9. The variable resistance causes each of the regions to be treated differently due to the trace resistances, parasitic characteristics, and/or other electrical characteristics of the display 18 to reduce display artifacts and/or increase display uniformity. Thus, the display 18 is then driven using the different VCOM driver resistances.

Although the foregoing process discusses determining a pixel location and a region to lookup a resistance values, in some embodiments, the resistance value may directly correspond to pixels such that knowledge of which pixel is enough to determine what the resistance value is. For example, each pixel may have a resistance value stored in a lookup table. Thus, in such embodiments, the active pixel location may be used to determine the resistance value without determining a region of pixels. Additionally or alternatively, the timing for a frame may be used since a specific time (e.g., 5 μs) would correspond to writing a specific pixel that has a location. In other words, the processor 12 may not determine location but instead may instead set the variable resistance based on timing within a frame.

Furthermore, although the foregoing discussion discusses using a processor to determine location and set a variable resistor, some embodiments of the electronic device 10 may perform at least some of the steps of the process 120 using other hardware, such as gate driver integrated circuits (GDICs). Moreover, in some electronic devices, one or more of the processors 12 may be included in the display 48 or may be separate from the display.

Figure 12:
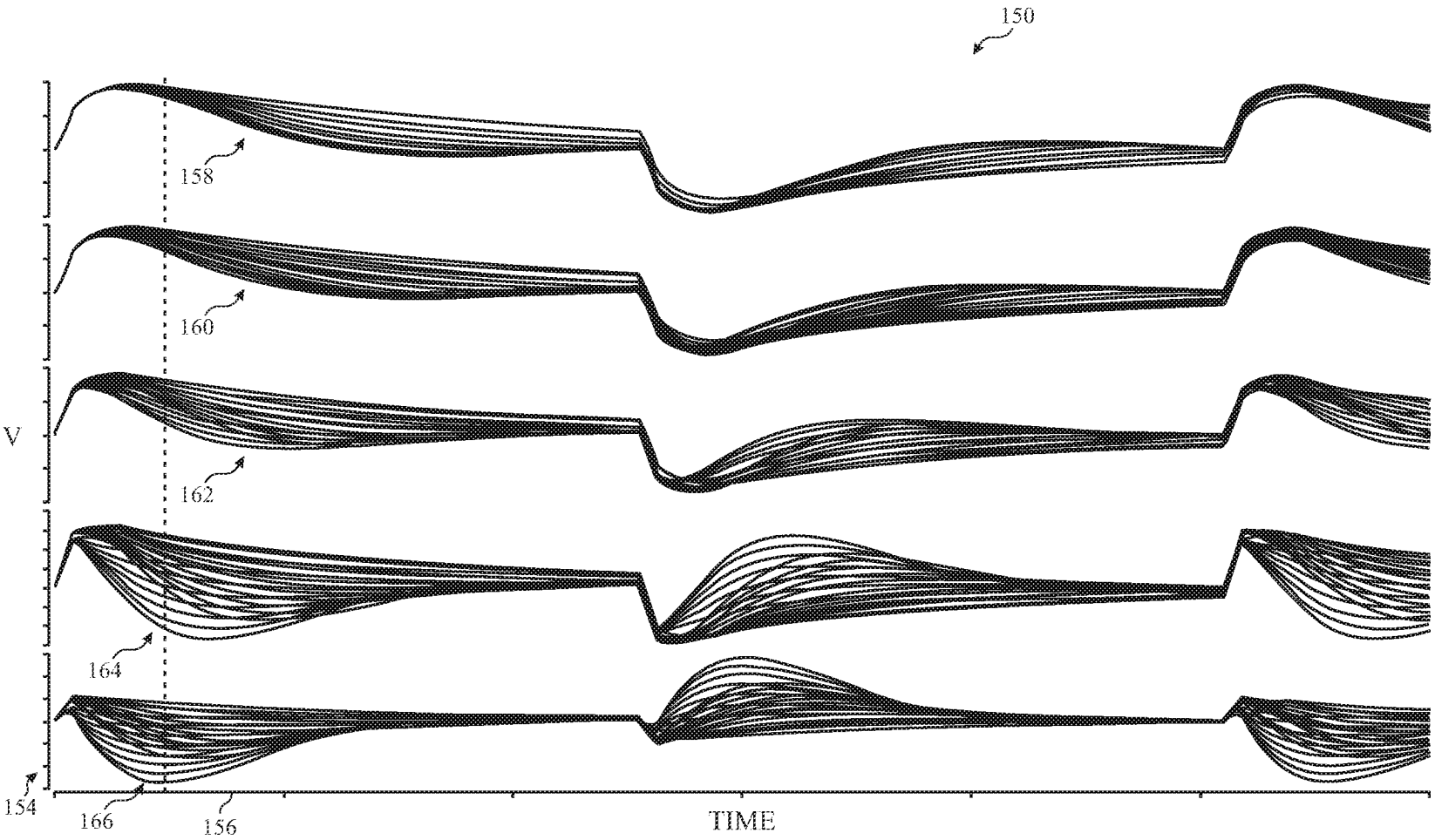
FIG. 12 illustrates an embodiment of a graph illustrating VCOM settling periods for a display, according to an embodiment.

FIG. 12 illustrates an embodiment of a graph 150 illustrating the settling periods for each of the regions 90-118. The graph 150 includes an ordinate that includes an ordinate 154 that corresponds to the VCOM voltage and an abscissa 156 that corresponds to time. The graph 150 also illustrates groups 158, 160, 162, 164, and 166 each representing one or more of the corresponding regions 90-118. For example, the group 158 may correspond to regions 90, 92, and 94. Similarly, group 160 may correspond to regions 96, 98, and 100; group 162 may correspond to regions 102, 104, and 106; group 164 may correspond to regions 108, 110, and 112; and group 166 may correspond to regions 114, 116, and 118. The graph 150 also illustrates an evaluation period 168 at which the VCOM voltage may be compared for analysis. As illustrated, the group 166 generally settles the quickest, and the settling times for the regions generally increase as the regions are further away from the common side 54.

Figure 13:
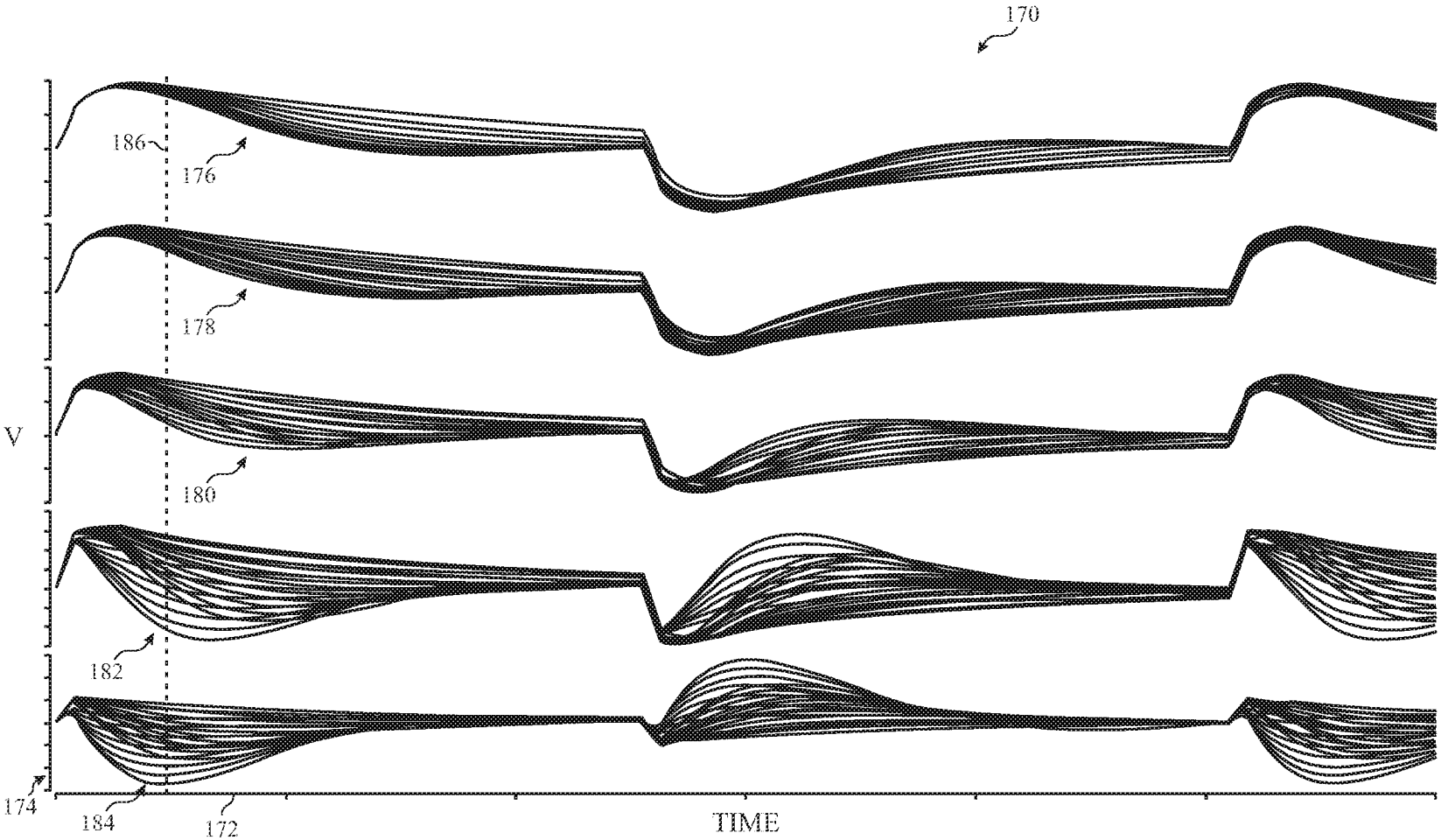
FIG. 13 illustrates an embodiment of a graph corresponding to a higher sheet resistance than that of FIG. 12, according to an embodiment.

Another way to reduce settling times is to reduce ITO sheet resistance. FIG. 13 illustrates a graph 170 corresponding to a display with a higher ITO sheet resistance than a display 18 used to generate the graph 150. The graph 170 includes an abscissa 172 that corresponds to time and an ordinate that includes an ordinate 174 that corresponds to the VCOM voltage. As illustrated, the settling times for VCOM voltages have generally improved for each group 176, 178, 180, 182, and 184 over their respective corresponding groups 158, 160, 162, 164, and 166. Specifically, the VCOM voltages illustrated in the graph 170 settled more quickly by the evaluation period 186 than the VCOM voltages illustrated in the graph 150 of FIG. 12. However, there is a physical limit to which the ITO sheet resistance may be practically reduced. For example, the limit may be based on of manufacturing capability, financial practicality, and/or other concerns.

Figure 14:
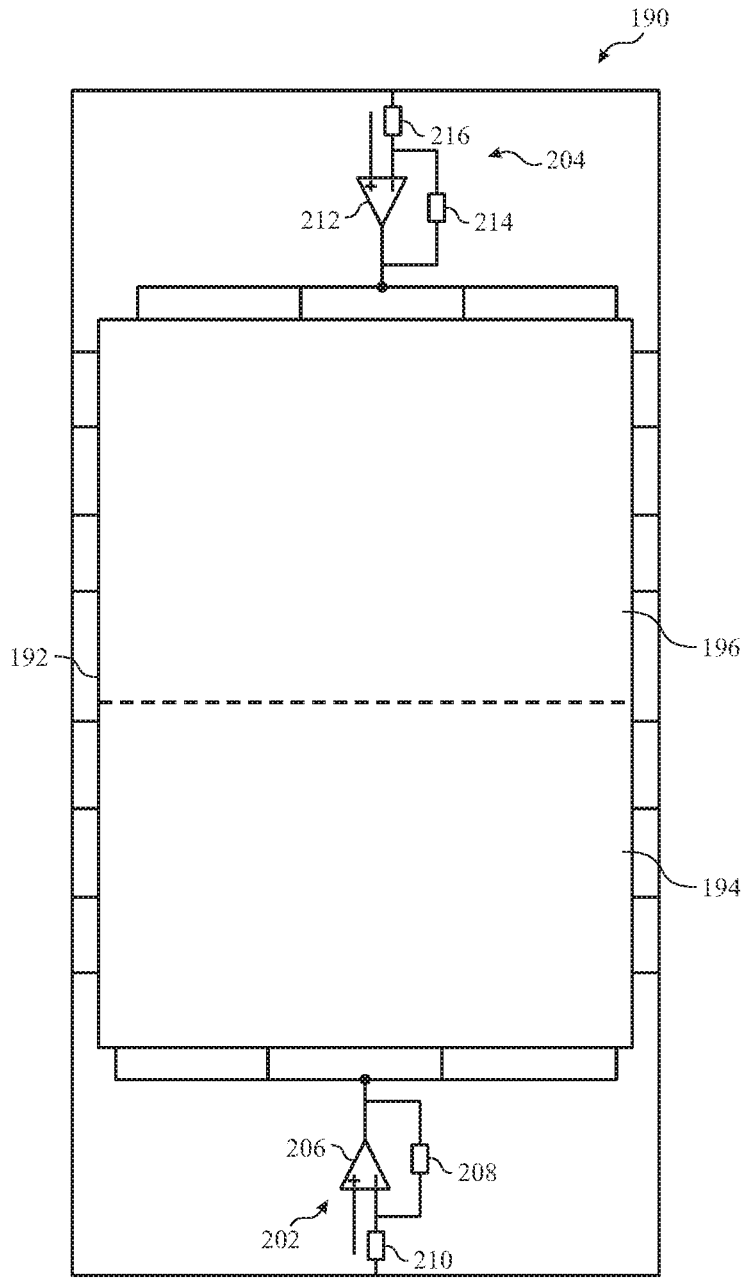
FIG. 14 illustrates an embodiment of a display that includes an active area divided into two regions, according to an embodiment.

In some cases to reduce VCOM settling times, some embodiments may include additional features. For example, FIG. 14 illustrates a display 190 that includes an active area 192 that is divided into two VCOM regions 194 and 196 that are driven by different VCOM amplifier circuits. Specifically, the VCOM region 194 is driven by VCOM amplifier circuit 202, and the VCOM region 196 is driven by the VCOM amplifier circuit 204.

The VCOM amplifier circuit 202 includes an amplifier 206 and resistors 208 and 210. In some embodiments, one or both of the resistors 208 and 210 may be variable resistors that vary resistance based on location of an active pixel in the region 194. For example, when the active pixel is further from the amplifier 206, the resistance may be set to a value higher than when the active pixel is closer to the amplifier 206. Similar to the VCOM amplifier circuit 202, the VCOM amplifier circuit 204 includes an amplifier 212 and resistors 214 and 216. Since the VCOM amplifier circuits 202 and 204 are physically closer to the most distant potential active pixel, the VCOM amplifier circuits 202 and 204 may have less trace (with relatively high impedances) between the VCOM amplifier circuits 202 and 204. The reduced resistance, among other factors, decreases VCOM settling times.

Figure 15:
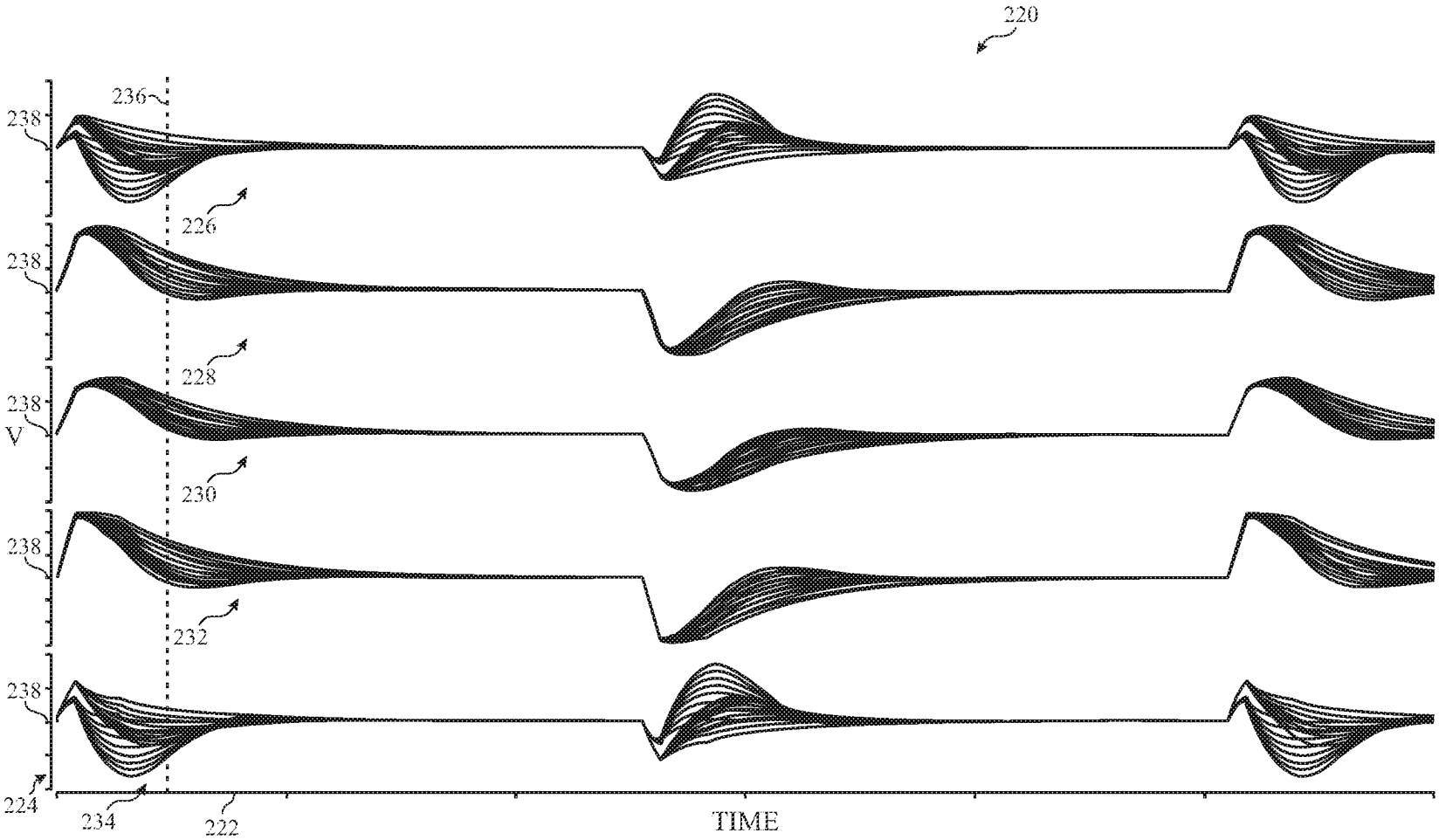
FIG. 15 illustrates a graph of the settling periods of the display of FIG. 14, according to an embodiment.

FIG. 15 illustrates a graph 220 of an embodiment illustrating the settling periods for each of the regions 90-118. The graph 220 includes an abscissa 222 that corresponds to time and an ordinate that includes an ordinate 224 that corresponds to the VCOM voltage. The graph 220 also illustrates groups 226, 228, 230, 232, and 234 each representing one or more of the corresponding regions 90-118. For example, the group 226 may correspond to regions 90, 92, and 94. Similarly, group 228 may correspond to regions 96, 98, and 100; group 230 may correspond to regions 102, 104, and 106; group 232 may correspond to regions 108, 110, and 112; and group 234 may correspond to regions 114, 116, and 118. The graph 220 also illustrates an evaluation period 236 at which the VCOM voltages may be evaluated as varying from a settling voltage 238. As illustrated, the VCOM voltages settle more quickly in graph 220 than in graphs 150 and 170. In other words, the VCOM voltages settle more quickly and/or fluctuate less at or after the evaluation period 236.

Figure 16:
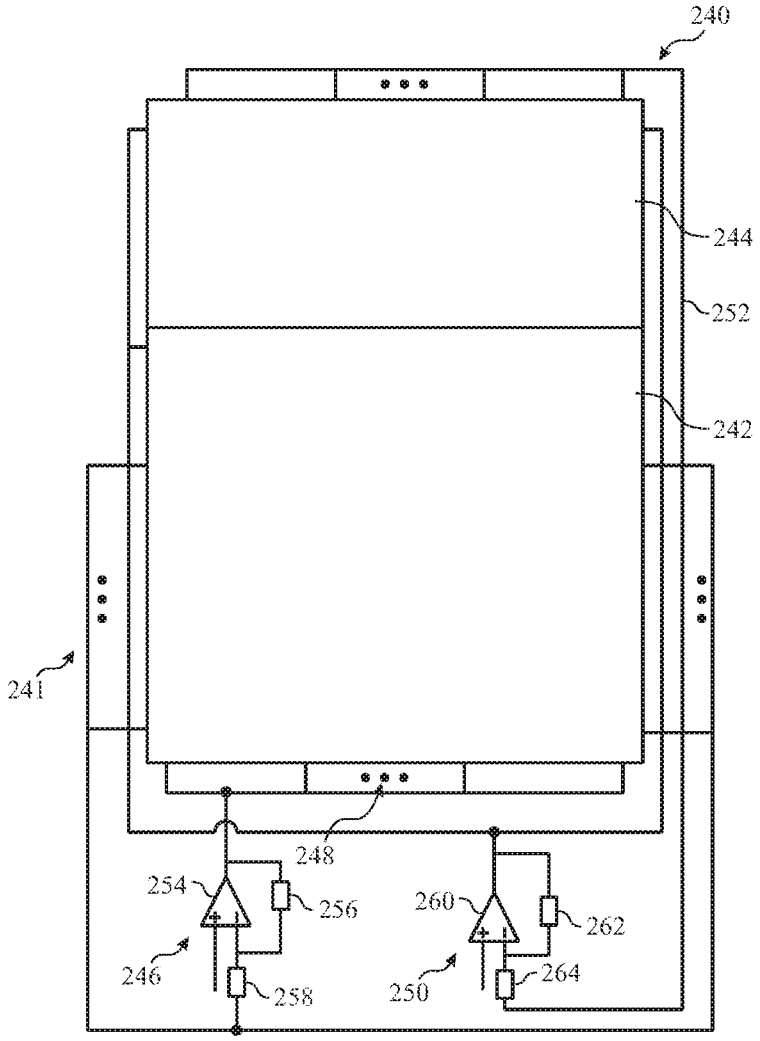
FIG. 16 illustrates a display with an active area divided into two regions and driven from a common side, according to an embodiment.

FIG. 16 illustrates a display 240 with an active area 241 divided into two regions 242 and 244. Each region is driven by different amplifier circuits. Specifically, the region 242 is driven by a VCOM amplifier circuit 246 via trace 248. Likewise, the region 244 is driven by a VCOM amplifier circuit 250 via trace 252. In the display 240, the VCOM amplifier circuits 246 and 250 are located at a same side of the display 240. Although the display 240 includes more VCOM trace than the display 190, the arrangement used in the display 240 may be used when the display 240 does not have space for a printed circuit board on both sides of the active area 241. Furthermore, to compensate for the additional trace used in coupling the VCOM amplifier circuit 250 to the region 244, the size of the region 244 may be smaller than the size of the region 242. In other words, a ratio of the sizes of the regions 242 and 244 may be greater than one. An exact ratio for each display type may be calculated based on display parasitics and/or other display characteristics to determine an ideal ratio for the display to reduce settling times for the display type.

The VCOM amplifier circuit 246 includes an amplifier 254 and feedback resistors 256 and 258. As noted above, one or both of the feedback resistors 256 and 258 may be variable resistors that are varied based on where the active pixel is located within the region 242. Similar to the VCOM amplifier circuit 246, the VCOM amplifier circuit 250 includes an amplifier 260 and feedback resistors 262 and 264.

Figure 17:
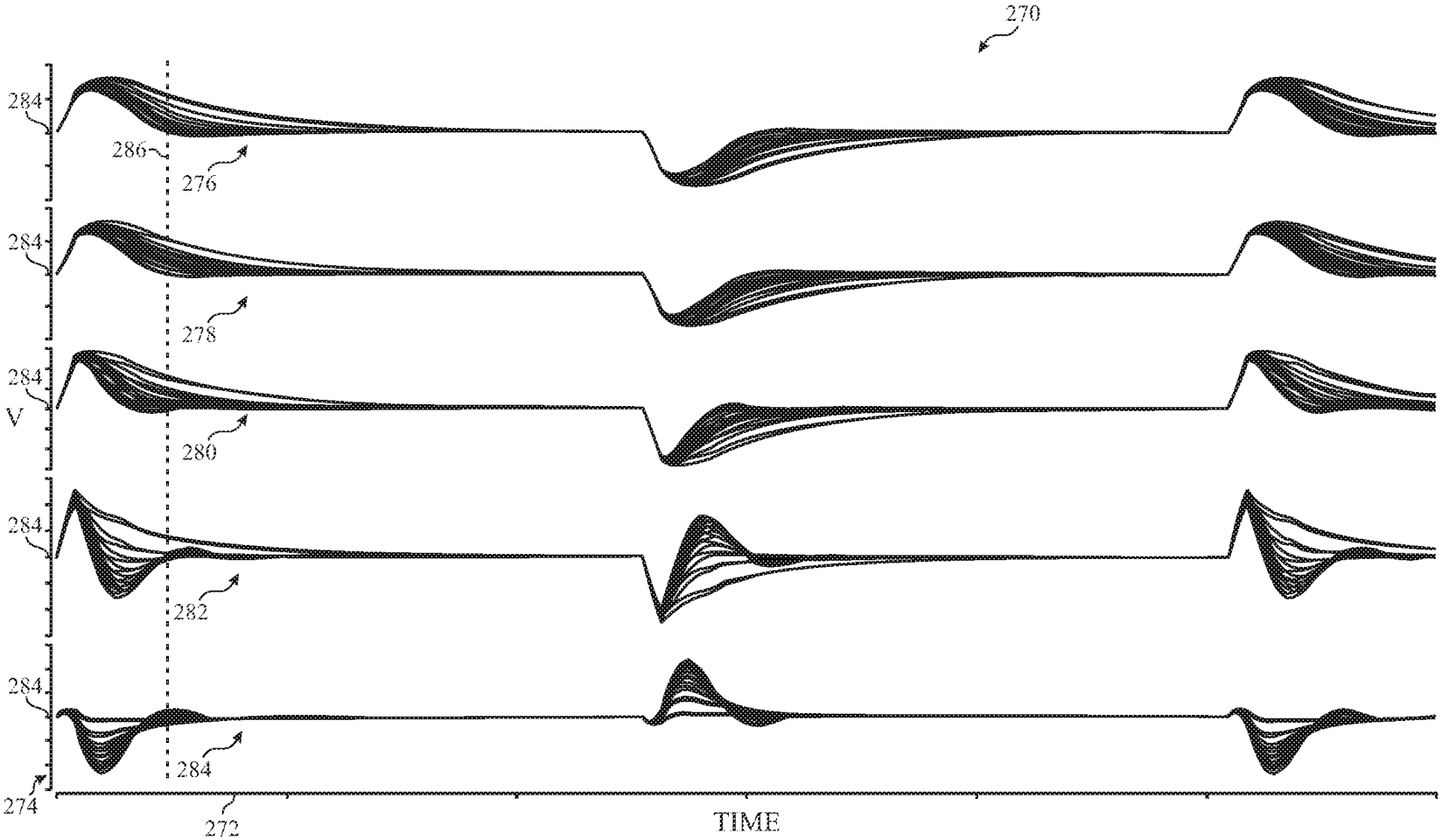
FIG. 17 illustrates a graph of the settling periods of the display of FIG. 16, according to an embodiment.

FIG. 17 illustrates a graph 270 of an embodiment illustrating the settling periods for each of the regions 90-118. The graph 270 includes an abscissa 272 that corresponds to time and an ordinate that includes an ordinate 274 that corresponds to the VCOM voltage. The graph 270 also illustrates groups 276, 278, 280, 282, and 284 each representing one or more of the corresponding regions 90-118. For example, the group 276 may correspond to regions 90, 92, and 94. Similarly, group 278 may correspond to regions 96, 98, and 100; group 280 may correspond to regions 102, 104, and 106; group 282 may correspond to regions 108, 110, and 112; and group 284 may correspond to regions 114, 116, and 118. The graph 270 also illustrates an evaluation period 286 at which the VCOM voltages may be evaluated as varying from a settling voltage. As illustrated, the VCOM voltages settle more quickly in graph 270 than in graphs 150 and 170. In other words, the VCOM voltages settle more quickly and/or fluctuate less at or after the evaluation period 286.

Figure 18:
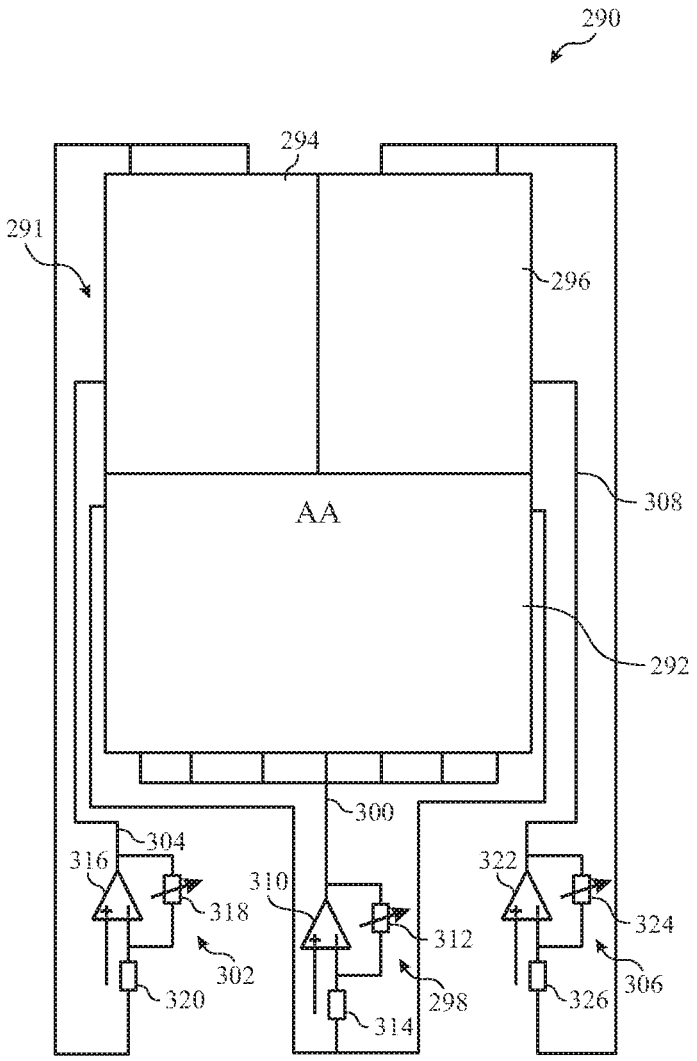
FIG. 18 illustrates a display with an active area divided into three regions, according to an embodiment.

FIG. 18 illustrates an embodiment of a display 290. The display 290 is divided into 3 regions: region 292, region 294, and region 296. The regions, 292, 294, and 296 are driven by different VCOM amplifier circuits 298, 302, and 306, respectively. In the illustrated embodiment, the region 292 that is closest to the VCOM amplifier circuits 298, 302, and 304 is larger than the other regions. By dividing the region(s) furthest from the VCOM amplifiers 298, 302, and 306 may include less trace than would otherwise be used if there were one solid region either for the whole active display or at least the portion of the display 290 that is not in region 292. Therefore, by reducing the trace, the impedance may be substantially reduced thereby decreasing VCOM settling periods to increase uniformity of appearance in the display 290.

Although the illustrated embodiment of the display 290 includes three regions, the display 290 may include more than three regions. For example, the display 290 may include four, five, six, or more regions. In some embodiments, the region 292 may be divided equally into 2 or more regions. Additionally or alternatively, the regions 294 and 296 may be divided differently. For example, the total space encompassed by regions 294 and 296 may be divided between 2 or more regions. These regions may be divided horizontally, vertically, or some combination thereof. The ratio of the sizes and/or numbers of the regions may be determined for each display/group of displays based on the parasitics and/or other electrical characteristics for each respective group/display.

The VCOM amplifier circuit 298 includes an amplifier 310 and resistors 312 and 314. In some embodiments, one or both of the resistors 312 and 314 may be variable resistors that vary resistance based on location of an active pixel in the region 292. For example, when the active pixel is further from the VCOM amplifier circuit 298, the resistance may be set to a value higher than when the active pixel is closer to the VCOM amplifier circuit 298.

Similar to the VCOM amplifier circuit 298, the VCOM amplifier circuit 302 includes an amplifier 316 and resistors 318 and 320, and the VCOM amplifier circuit 306 includes an amplifier 322 and resistors 324 and 326. In some embodiments, one or more of the resistors 318, 320, 324, and 326 may be variable resistors that vary resistance based on location of an active pixel in the regions 294 and 296. For example, when the active pixel is further from the VCOM amplifier circuits 302 and 306, the resistance may be set to a value higher than when the active pixel is closer to the VCOM amplifier circuits 302 and 306.

Since the connections in VCOM regions 294 and 296 and between the VCOM regions and the VCOM amplifier circuits 302 and 306 are smaller with shorter trace (e.g., around only one side of active area 291), the VCOM amplifier circuits 302 and 306 may have less trace (with relatively high impedances) between the VCOM amplifier circuits 302 and 306. The reduced resistance, among other factors, decreases VCOM settling times, as previously discussed.

Figure 19:
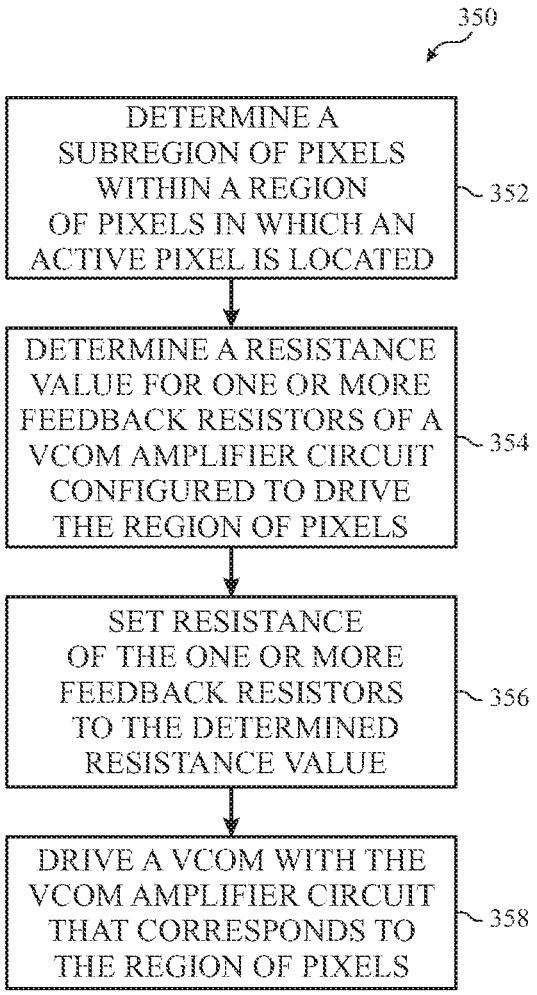
FIG. 19 illustrates a flowchart of a process for driving VCOM voltages, according to an embodiment.

FIG. 19 illustrates a flowchart diagram of an embodiment of a process 350 for operating a display. The process 350 includes determining a subregion of pixels within a region of pixels of an active area of a display in which an active pixel is located (block 352). The region corresponds to a number of pixels driven by a VCOM amplifier circuit out of a number of VCOM amplifier circuits. The subregions include strips of pixels in the region that are different distances from the corresponding VCOM amplifier. In other words, each of the regions may benefit from being driven by the VCOM amplifier with different resistance values for one or more feedback resistors of a feedback loop of the VCOM amplifier circuit.

Based on at least the location of the active pixel within the subregion, determine a resistance value for one or more feedback resistors of the VCOM amplifier circuit (block 354). Set the resistance of the one or more feedback resistors to the determined resistance value (block 356). Once the resistance value is set, drive a VCOM with the VCOM amplifier circuit that corresponds to the region of the pixels using the one or more feedback resistors and determined resistance value (block 358).

It may be understood that the foregoing process may be embodied using hardware, software, or some combination thereof. For example, a general processor and/or graphics processor may be used to perform instructions stored in memory that are configured to cause the processor to perform the process 350, when executed.

VCOM tuning based by fixed panel location may be very location-specific with less global representation. Furthermore, VCOM tuning may be hard to compensate for gate kickback delta from panel to panel and temperature variation. Also, for large-size panels, a VCOM DC profile may be less uniform causing more complication for larger panels. Moreover, panel edge location variation may be large due to kick back differences and other non-uniformities in the panels.

Figure 20:
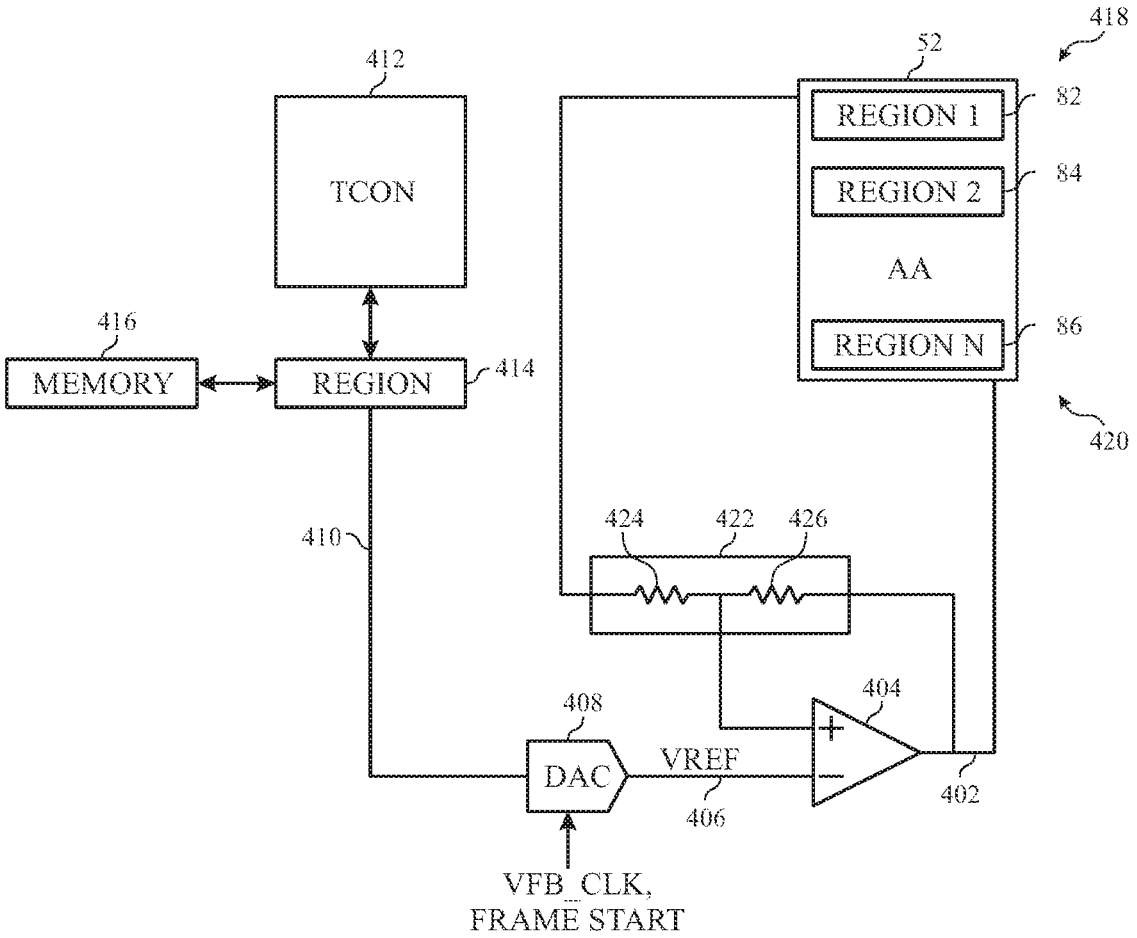
FIG. 20 illustrates a display driving system for driving an active area of a display using variable VCOM voltages, according to an embodiment.

Thus, as an addition to or an alternative to VCOM tuning as described above, VREF may be adjusted through DAC control based on VFB_CLK and Frame Start to determine position/region of data being written. FIG. 20 illustrates an embodiment of a display that includes the active area 52 consisting of pixels logically grouped into regions 82, 84, and 86. The active area 52 receives a VCOM voltage 402 from a VCOM amplifier 404. The DC voltage of the VCOM voltage 402 may be varied for each line of pixels using a profile for the entire display 18. The VCOM voltage 402 is controlled using a reference voltage (VREF) 406. This reference voltage may be adjusted using a digital-to-analog converter (DAC) 408 that receives a digital signal 410 and/or additional signals (e.g., VFB_CLK and Frame Start pulses). The digital signal may be derived from a timing controller (TCON) 412. The timing controller 412 is in communication with region-based logic 414 may be programmable from the TCON 412. In some embodiments, the TCON 412 may be programmable using an inter-integrated circuit (I2C) protocol connection or Serial Peripheral Interface (SPI) busing to send data to the DAC 308 via the region-based logic 414. In some embodiments, each region 82, 84, and 86 may have corresponding separate logic, such that a single region-based logic 414 is dedicated to a specific region. Alternatively, the region-based logic 414 may correspond to more than a single region (e.g., entire panel) with different settings for different regions. In some embodiments, some settings or values may be stored in a memory 416 that may be retrieved by the region-based logic 414 and/or the TCON 412 for use in controlling regions of the active area 52.

In some embodiments, a VCOM for a far portion 418 of the active area 52 may be proportional a VCOM for a near portion 420 of the active area. This proportion (and resulting amplification at the amplifier 404) may be controlled by voltage control 422 that includes resistors 424 and 426. In some embodiments, these resistors may be variable and controlled using the TCON 412 and/or the region-based logic 414 in the processes described above. Additionally or alternatively, the VCOM voltages into various portions of the active area 52 may be controlled using VREF manipulation.

Figure 21:
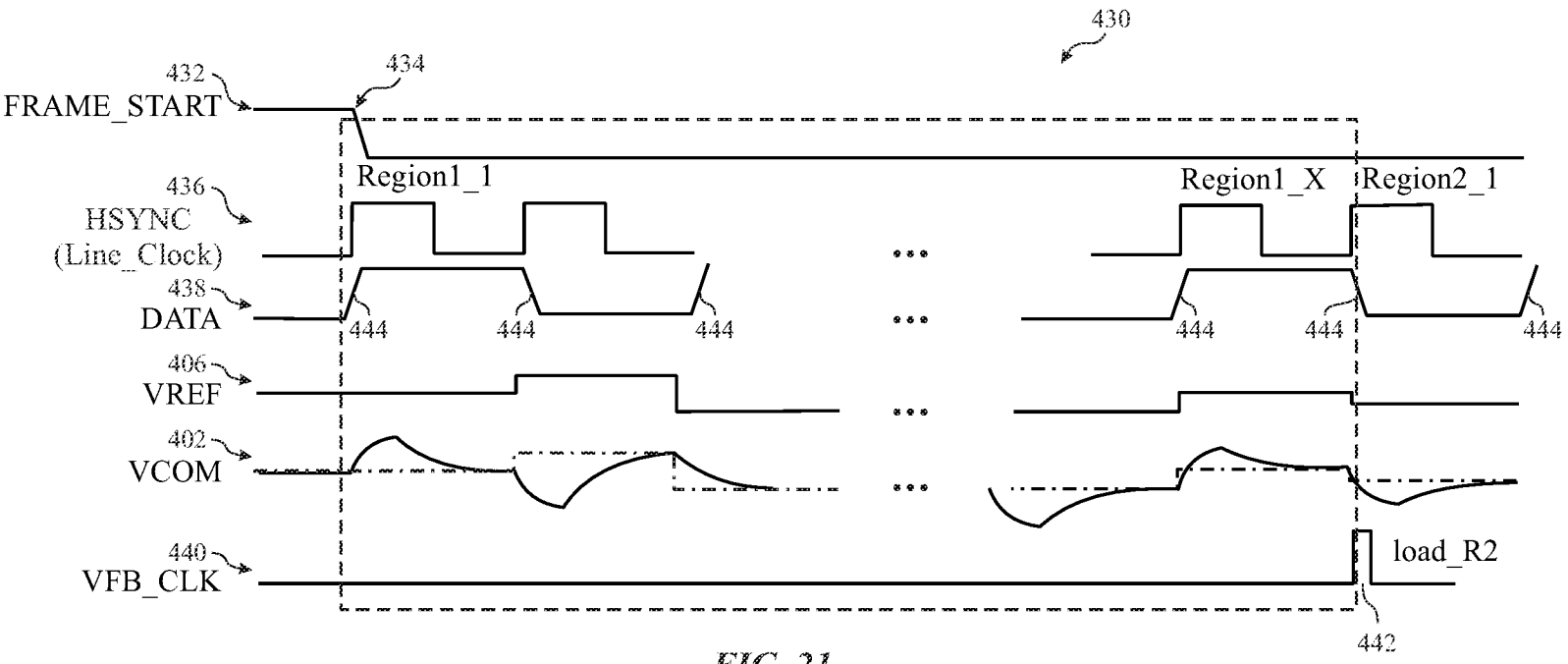
FIG. 21 illustrates a timing diagram for operating the display driving system of FIG. 20, according to an embodiment.

FIG. 21 illustrates an embodiment of a timing diagram 430 that may be used to adjust the VREF 406 to control the VCOM 402. As illustrated, a frame of data begins using a frame start signal 432. In some embodiments, the frame start signal 432 may be a pull down signal that indicates a start 434 of a frame of data when pulled down. Alternatively, the frame start signal 432 may be a pull up signal. The timing diagram 430 also illustrates a line clock 436 that is used to write data 438 to lines of pixels in the active area 52. Although the illustrated embodiment includes a horizontal synchronization, some embodiments may include vertical synchronizations with all discussion applicable to lines being instead applied to columns. The VREF voltage 406 is set using TCON 412 and/or the region-based logic 414 (as well as the frame start signal 432 and a VFB_CLK signal 440). The VFB_CLK signal 440 is used to indicate that a new region is being written to. For example, a pulse 442 in the VFB_CLK signal 440 indicates that writing of pixels has switched regions. For example, before the pulse 442, data may have been written to pixels in the region 82 while data may be written to pixels in the region 84 after the pulse 442. To ensure that data is properly (and consistently) written, changes in the VREF 406 may be synchronized with changes to transition edges 444 of the data 438. Using a line-by-line-based profile for VCOM DC levels for each line in the active profile, the active area 52 may be driven according to lines at least in part by adjusting the VREF 406.

Figure 22:
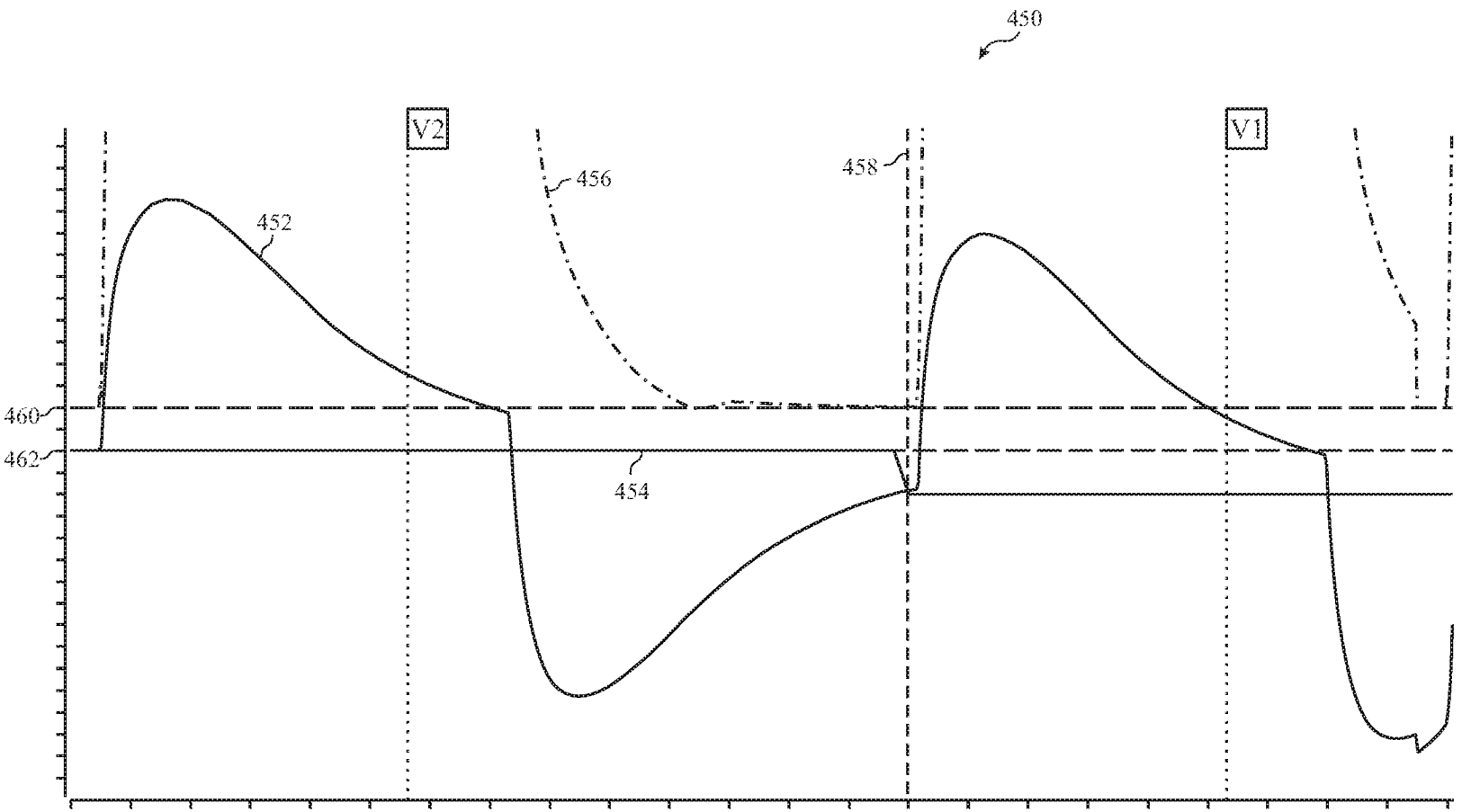
FIG. 22 illustrates a change on VCOM voltages using a change in VREF voltages and the effect on VCOM settling times when the VREF voltage shifts down, according to an embodiment.

FIG. 22 is an illustration of a graph 450 of an embodiment of the VCOM 402 and VREF 406 during operation of the active area 52. The graph 450 includes a line 452 corresponding to VCOM 402, a line 454 corresponding to VREF 406, and a line 456 corresponding to data 438. As illustrated, the line 452 corresponding to VREF 406 shifts down at time 458 that corresponds to a transition in line 456 corresponding to data 438. The shift in VREF 406 results in a shift in VCOM 402 as illustrated by the line 452. Specifically, when the VREF 406 is at a higher value, the VCOM 402 is at a first value 460, but when the VREF 406 drops, VCOM 402 drops to a second value 462. Note that the settling period of the VCOM 402 is not changed by shifts in the VREF 406. An amount of shift may be controlled and/or limited by feedback loop transient dynamics. Furthermore, in some embodiments, a VCOM DC target may be determined using a calibration step for a batch of panels, for each panel, for a type of panel, or other suitable groupings by optically inspecting the display to determine what profile should exist for each line.

Figure 23:
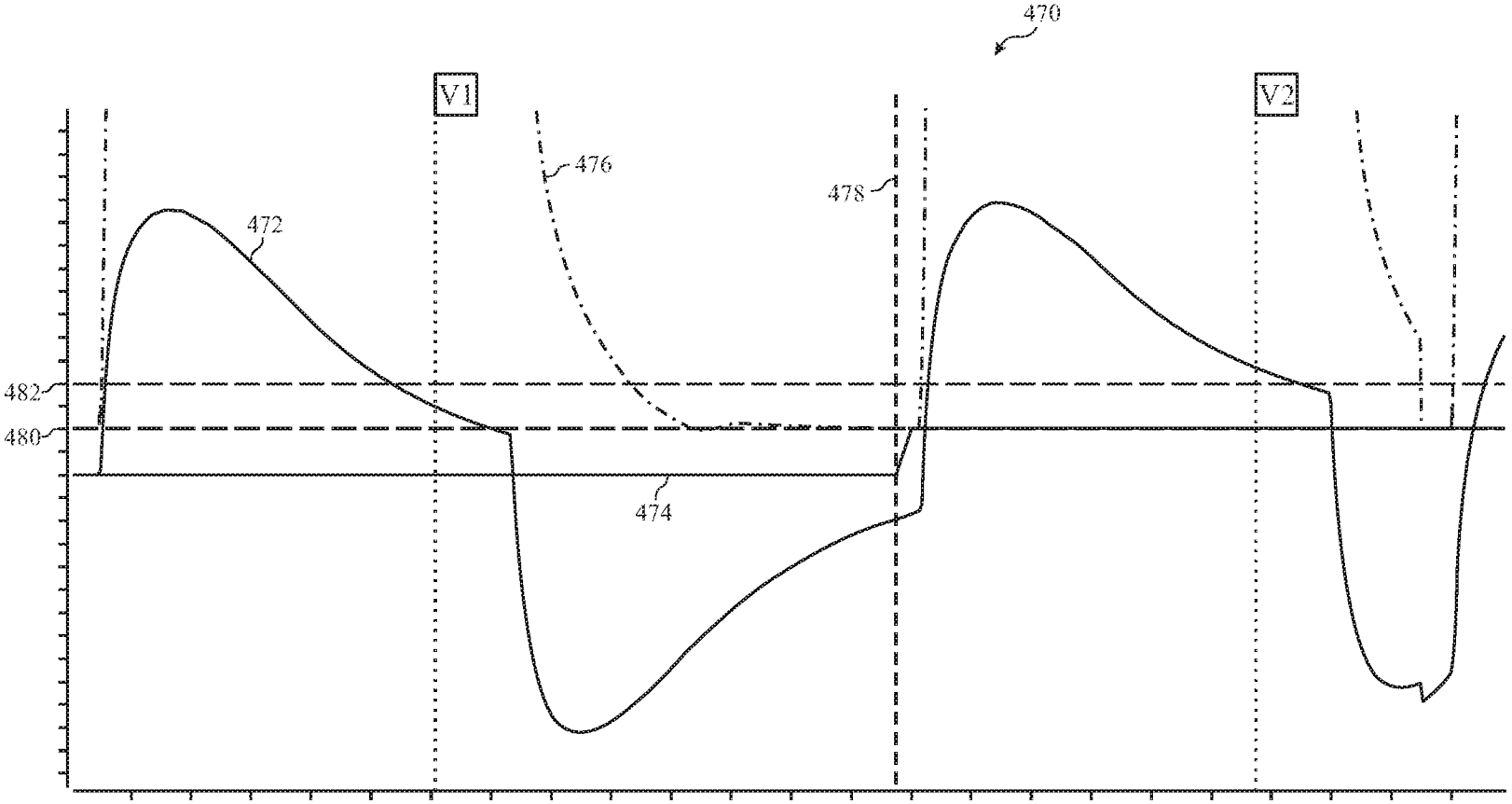
FIG. 23 illustrates a change on VCOM voltages using a change in VREF voltages and the effect on VCOM settling times when the VREF voltage shifts up, according to an embodiment.

FIG. 23 illustrates a graph 470 that is similar to the graph 450 but illustrates an increase as a shift in VREF 406. The graph 470 includes a line 472 corresponding to VCOM 402, a line 474 corresponding to VREF 406, and a line 476 corresponding to data 438. As illustrated, the line 472 corresponding to VREF 406 shifts up at time 478 that corresponds to a transition in line 476 corresponding to data 438. The shift in VREF 406 results in a shift in VCOM 402 as illustrated by the line 472. Specifically, when the VREF 406 is at a lower value, the VCOM 402 is at a first value 480, but when the VREF 406 increases, VCOM 402 drops to a second value 482. Again, note that the settling period of the VCOM 402 is not changed by shifts in the VREF 406.

Figure 24:
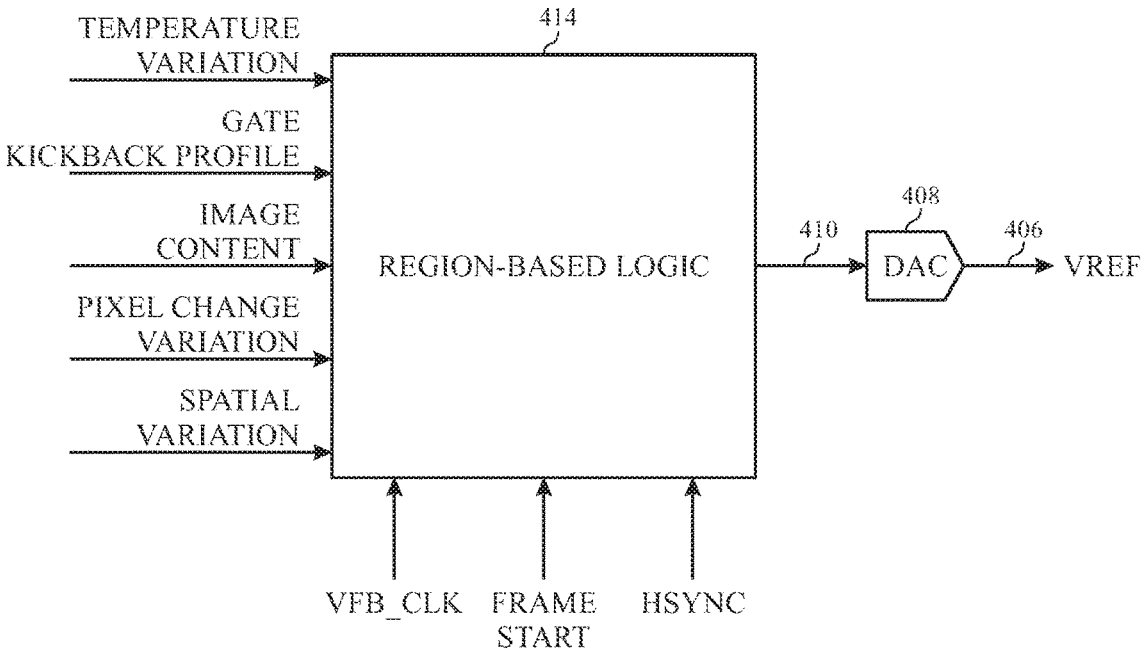
FIG. 24 illustrates a schematic view of region-based logic used to set a signal to control VREF voltages to control VCOM voltages, according to an embodiment.

FIG. 24 illustrates a schematic diagram of various inputs that may be used to effect VREF control using the DAC 408 via the region-based logic 414. The region-based logic 414 may be implemented using hardware, software, or a combination thereof. The region-based logic 414 may vary the VREF 406 based on temperature variation, gate kickback profile, image content, pixel charge variation, other panel spatial variation (e.g., variation between regions as discussed previously), and/or other various factors relevant to operation of the active area 52. Furthermore, to synchronize changes to the VREF 406 to writing of a specific region and a specific line in the region, the region-based logic 414 and/or DAC 408 may receive the frame start signal 432, the VFB_CLK signal 440, and the HSYNC signal 436. The frame start signal 432 indicates that a new frame has begun and an initial region is being written. The VFB_CLK signal 440 indicates that a new region is being actively written. The VFB_CLK signal 440 may be a pre-determined number of clock cycles (e.g., of the HSYNC signal 436) based at least in part of a size of regions in the active area 52. For example, in some embodiments, if the active area 52 is logically divided into regions consisting of 100 lines, the VFB_CLK signal 440 would correspond to 100 ticks of the HSYNC signal 436. The HSYNC signal 436 (or VSYNC signal) indicates that a subsequent line (or column) in the region is being written. Using these signals as well as the parameters listed above, the region-based logic 414 and/or the DAC 408 may compensate for variations (e.g., incomplete pixel charging in far regions of the active area 52) during operation of the display 18 to cause the active area 52 to appear more uniform.

Furthermore, line-based VCOM tuning may be used with a somewhat uniform VCOM DC profile. Line-based VCOM tuning also may be applied to panels having large sizes with high refresh rates without substantially negatively changing settling periods of VCOMs that may occur using direct VCOM tuning. Temperature variation may also incorporated in the VCOM DC level variation of line-based VCOM tuning. The line-based VCOM tuning may also be easily applied to region-specific applications where regions include 1 or more complete lines. Thus, line-based VCOM tuning may also be applied as compensation for location-based incomplete pixel charging as refresh rates increase. Furthermore, content-based VCOM tuning may be combined with line-based VCOM tuning such that specific content in pixels in a line (or in a frame) may at least partially change what the VREF level during writing of the line to cause a specific VCOM level.

Figure 25:
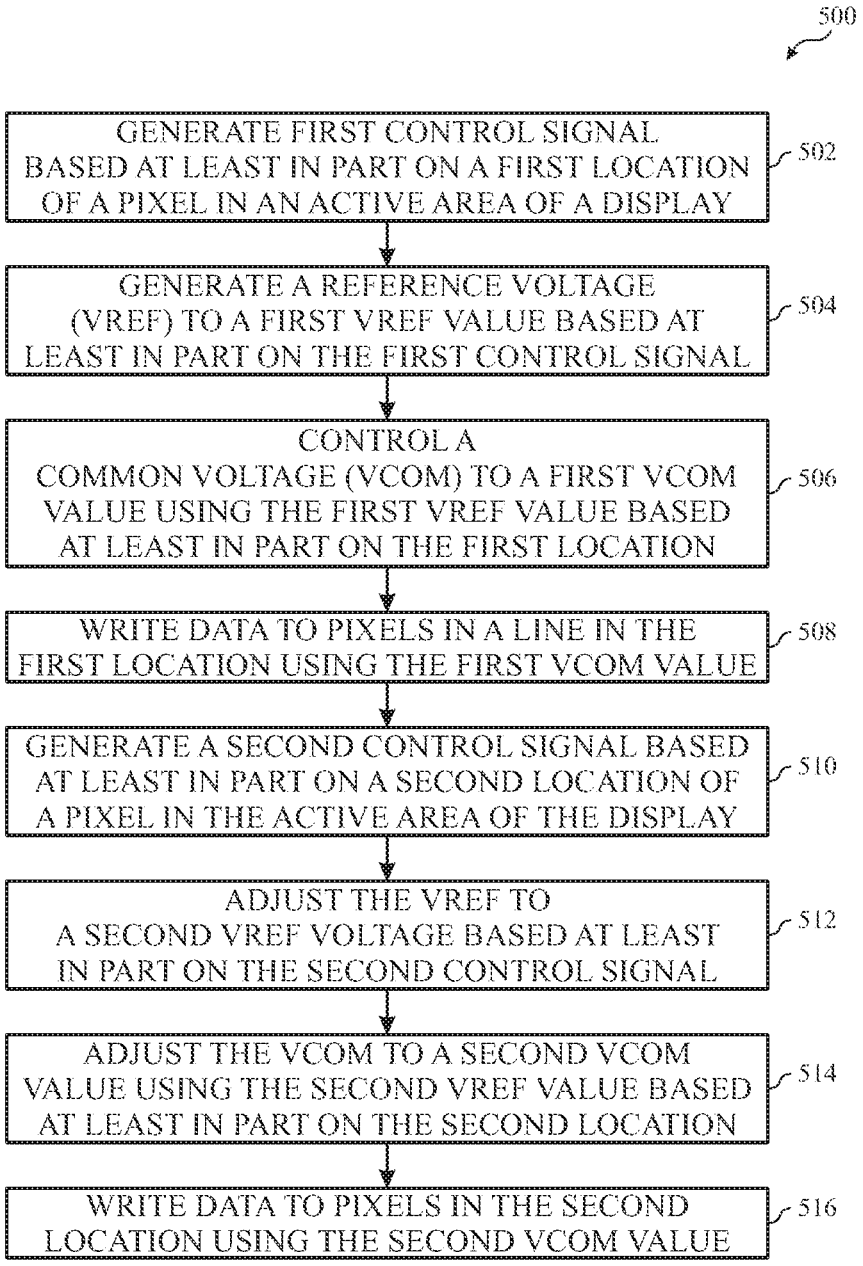
FIG. 25 illustrates a flow diagram for operating the display driving system of FIG. 20, according to an embodiment.

FIG. 25 illustrates a flow diagram of a process 500 for line-based VCOM tuning. The process 500 may be implemented using TCON 412, region-based logic 414, memory 416, and/or DAC 408. The process 500 includes generating a first control signal (e.g., digital signal 410) based at least in part on a first location of a pixel in an active area of a display (block 502). For example, the location may include which region in an active display in which the pixel is included. Moreover, the first control signal may also be based at least in part on based on temperature variation, gate kickback profile, image content, pixel charge variation, other panel spatial variation (e.g., variation between regions as discussed previously), and/or other various factors relevant to operation of the active area 52. A reference voltage is generated to a first VREF value based at least in part on the first control signal (block 504). Using the first VREF value, a common voltage (VCOM) is controlled based at least in part on the first location (block 506). Using the first VCOM value, data is written to pixels in a line in the first location (block 508).

When a new line in a new location and/or region is to be written, a second control signal is generated based at least in part on a second location of a pixel in the active area of the display (block 510). Based at least in part on the second control signal, the VREF is adjusted to second VREF value (block 512). Using the second VREF value, the VCOM is adjusted to a second VCOM value based at least in part on the second location (block 514). Using the second VCOM value data is written to pixels in the second location (block 516).

Figure 26:
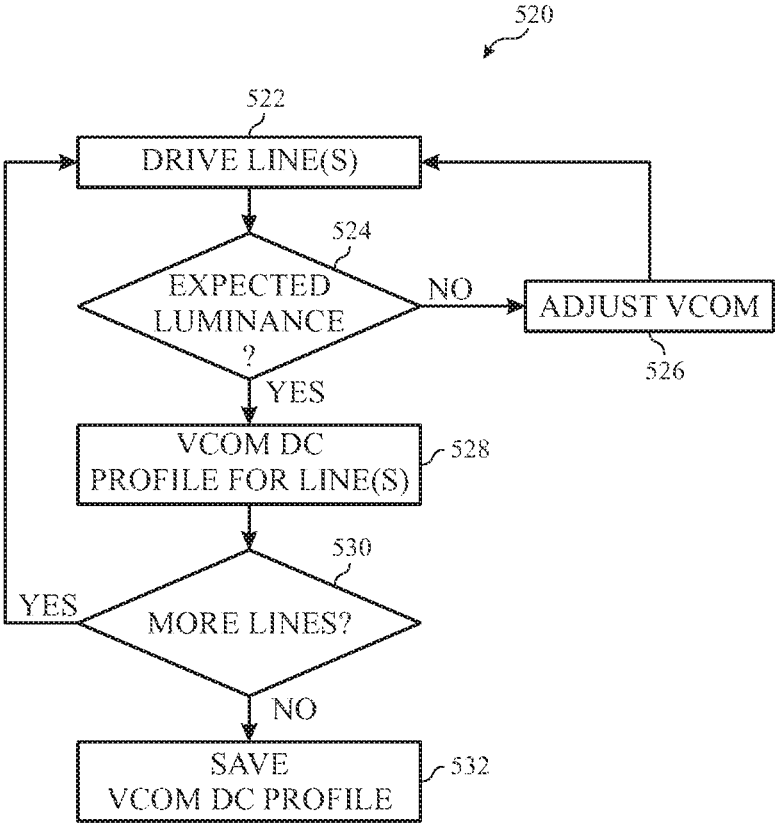
FIG. 26 illustrates a flow diagram for calibrating the display driving system of FIG. 20 to determine VCOM voltage levels by line(s), according to an embodiment.

FIG. 26 illustrates a flow diagram for a process 520 for line-based VCOM tuning. The process 520 includes driving at least one line of pixels in an active area 52 of a display (block 522). The driving may include driving the line at a default VCOM level. Determine whether luminance is at an expected level (block 524). Determining whether the luminance is at the expected level may include using an optical scanner to determine luminosity of the display at the lines. If the luminance level is not at the expected level, a VCOM level may be adjusted for the line(s) (block 526). For example, if the luminance is below the expected level, the VCOM level may be increased. In some embodiments, the VCOM may be increased by adjusting the VREF voltage. After the VCOM level is adjusted luminance of the line(s) may be reevaluated. In some embodiments, line(s) may be repetitively tested before testing other line(s). In certain embodiments, line(s) that have not produced an expected luminance may be retested after other lines in the active area have been tested. Eventually, the line(s) produce an expected luminance. After achieving an expected luminance, the VCOM DC profile may be adjusted for the line(s) (block 528). If more line(s) are to be evaluated (block 530), the process repeats driving the line(s) at block 530. Once all lines have been evaluated to determine a proper VCOM DC profile for each line, the VCOM DC profile for the display with variation by line(s) may be saved (block 532). For example, the VCOM DC profile may be stored in the memory 416 for later use during operation of the display 18.

Furthermore, in some embodiments, the evaluation process for the display 18 using the process 520 may incorporate other variations, such as temperature variation, gate kickback profile, image content, refresh rate, and/or other operating condition variations. These values and resulting VCOM DC profile may be stored in a look up table in the memory 416 such that the VCOM DC profile may be varied based on operating conditions beyond location of the pixels being written to enhance an appearance of uniformity for the display.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic device comprising:

a display comprising:

an active area comprising a plurality of pixels divided into:

a near region that extends fully across the active area in a first direction;

a first far region that is adjacent to the near region in a second direction and extends across a first portion of the active area in the first direction; and a second far region that is adjacent to the near region in the second direction and is adjacent to the first far region in the first direction and extends across a second portion of the active area in the first direction, wherein the active area is configured to transmit light; and a plurality of common voltage (VCOM) driving circuits, wherein:

a first VCOM driving circuit of the plurality of VCOM driving circuits is configured to drive a first common electrode of the plurality of pixels for the near region, a second VCOM driving circuit of the plurality of VCOM driving circuits is configured to drive a second common electrode of the plurality of pixels for the first far region, and a third VCOM driving circuit of the plurality of VCOM driving circuits is configured to drive a third common electrode of the plurality of pixels for the second far region, wherein each of the plurality of VCOM driving circuits comprises a variable resistor configured to be driven to a resistance level based at least in part on a location of an active pixel within a corresponding region.

2. The electronic device of claim 1, wherein the active area comprises four edges, and the plurality of VCOM driving circuits are located adjacent to a single edge of the four edges.

3. The electronic device of claim 2, wherein the plurality of VCOM driving circuits are located on opposite ends of an edge of the active area.

4. The electronic device of claim 1, wherein a ratio of a size of the near region to a size of the first far region is greater than one.

5. The electronic device of claim 4, wherein each pixel location indexed with a corresponding resistance value.

6. An electronic device comprising:

a plurality of pixels in an active area logically divided into a plurality of regions, wherein the active area is configured to transmit light, and the plurality of regions comprises:

a near region that extends fully across the active area in a first direction;

a first far region that is adjacent to the near region in a second direction and extends across a first portion of the active area in the first direction; and a second far region that is adjacent to the near region in the second direction and is adjacent to the first far region in the first direction and extends across a second portion of the active area in the first direction;

a plurality of common voltage (VCOM) driving circuits, wherein:

a first VCOM driving circuit of the plurality of VCOM driving circuits is configured to drive a first common electrode of the plurality of pixels, a second VCOM driving circuit of the plurality of VCOM driving circuits is configured to drive a second common electrode of the plurality of pixels for the first far region, and a third VCOM driving circuit of the plurality of VCOM driving circuits is configured to drive a third common electrode of the plurality of pixels for the second far region, wherein each of the plurality of VCOM driving circuits comprises a variable resistor configured to be driven to a resistance level based at least in part on which corresponding region of the plurality of regions includes an active pixel within the region; and a processor configured to set the resistance level of each variable resistor based at least in part on the respective region of the plurality of regions.

7. The electronic device of claim 6, wherein the plurality of regions is divided based on distances from the VCOM driving circuit.

8. The electronic device of claim 7, wherein the distances comprise a length of trace between each region and the VCOM driving circuit.

9. The electronic device of claim 7, wherein the processor is configured to select a VCOM driving circuit out of a plurality of VCOM driving circuits based at least in part on which portion of the active area contains the respective region.

10. A method for operating a display comprising:

determining locations of active pixels, wherein the locations comprise a subregion within a plurality of regions of an active area of the display, wherein each region corresponds to a common voltage (VCOM) driving circuit of a plurality of VCOM driving circuits and each subregion corresponds to a group of pixels within the region, and the plurality of regions comprises:

a near region that extends fully across the active area in a first direction and is driven by a first VCOM driving circuit of the plurality of VCOM driving circuits;

a first far region that is adjacent to the near region in a second direction and extends across a first portion of the active area in the first direction and is driven by a second VCOM driving circuit of the plurality of VCOM driving circuits; and a second far region that is adjacent to the near region in the second direction and is adjacent to the first far region in the first direction and extends across a second portion of the active area in the first direction and is driven by a third VCOM driving circuit of the plurality of VCOM driving circuits;

determining respective first, second, and third resistance values based at least in part on the locations of the active pixels;

setting resistance levels of first, second, and third variable resistors of the VCOM driving circuit to the determined respective first, second, and third resistance values; and driving first, second, and third common electrodes to respective first, second, and third VCOM using the respective first, second, and third VCOM driving circuits.

11. The method of claim 10, wherein setting the resistance levels of the first, second, and third variable resistors of the first, second, and third VCOM driving circuits comprises setting the resistance levels of the respective first, second, and third variable resistors that each provides negative feedback to respective amplifier of the respective first, second, and third VCOM driving circuits.

12. A non-transitory, computer-readable medium storing instructions thereon that when executed are configured to cause a processor to:

if an active pixel of an active area of a display is located in a near region of the display, set a resistance of a variable resistor of a VCOM driving circuit to a first resistance value, wherein the near region extends fully across the active area in a first direction;

if the active pixel is located in a first far region of the display, set the resistance of the variable resistor to a second resistance value, wherein the first far region is adjacent to the near region in a second direction and extends across a first portion of the active area in the first direction wherein the first resistance value and the second resistance value are a same value;

if the active pixel is located in a second far region of the display, set the resistance of the variable resistor to a third resistance value, wherein the second far region is adjacent to the near region in the second direction, is adjacent to the first far region in the first direction, and extends across a second portion of the active area in the first direction; and drive a common electrode to a VCOM level using the VCOM driving circuit.

13. The non-transitory, computer-readable medium of claim 12, wherein the instructions are configured to cause the processor to select the VCOM driving circuit from a plurality of VCOM driving circuits based at least in part on a location of the active pixel.

14. The non-transitory, computer-readable medium of claim 12, wherein the near region is larger than the first far region.

15. The non-transitory, computer-readable medium of claim 12, wherein the near region is larger than the second far region.

16. An electronic display comprising:

a plurality of pixels;

a first common voltage (VCOM) driving circuit configured to provide a first voltage to a common electrode for a first region of the plurality of pixels; and a second VCOM driving circuit configured to provide a second voltage to a common electrode for a second region of the plurality of pixels, wherein the plurality of pixels comprise four sides around the plurality of pixels, a top surface to transmit light from the electronic display, and a bottom surface that is opposite the top surface, and the first and second VCOM driving circuits are disposed on a common side of the four sides, and the first region is larger than the second region when first region is located closer to the first and second VCOM driving circuits than the second region.

17. The electronic display of claim 16 comprising a third VCOM driving circuit configured to provide a third voltage to a common electrode for a third region of the plurality of pixels.

18. The electronic display of claim 17, wherein:

the first region of the plurality of pixels extends fully across the plurality of pixels in a first direction but only a fraction of a length across the plurality of pixels in a second direction;

the second region of the plurality of pixels is adjacent to the first region in the second direction; and the third region of the plurality of pixels is adjacent to the first region in the second direction, wherein the second and third regions are adjacent to each other in the first direction.

19. The electronic display of claim 18, wherein the first, second, and third VCOM driving circuits are disposed on a common side of the plurality of pixels.

20. The electronic display of claim 19, wherein the fraction is based at least in part on parasitics of the electronic display.

21. The electronic display of claim 16 comprising:

a third VCOM driving circuit configured to provide a third voltage to a common electrode for a third region of the plurality of pixels; and a fourth VCOM driving circuit configured to provide a fourth voltage to a common electrode for a fourth region of the plurality of pixels.

22. The electronic display of claim 16, wherein the first and second VCOM driving circuits are disposed at opposite ends of the plurality of pixels.

* * * * *